US007876055B2

(12) United States Patent
Hosaka et al.

(10) Patent No.: US 7,876,055 B2
(45) Date of Patent: Jan. 25, 2011

(54) LAMP-LIGHTING APPARATUS

(75) Inventors: Yasuo Hosaka, Gunma (JP); Yoshihisa Konno, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 110 days.

(21) Appl. No.: 12/338,881

(22) Filed: Dec. 18, 2008

(65) Prior Publication Data

US 2009/0146578 A1 Jun. 11, 2009

Related U.S. Application Data

(63) Continuation of application No. 11/267,007, filed on Nov. 4, 2005, now Pat. No. 7,573,205.

(30) Foreign Application Priority Data

Nov. 5, 2004 (JP) ..... 2004-322302
Jul. 28, 2005 (JP) ..... 2005-218201

(51) Int. Cl.
*H05B 41/16* (2006.01)

(52) U.S. Cl. ..... 315/277

(58) Field of Classification Search ..... 315/276, 315/277, 291, 312, 224, 244, DIG. 7, 7
See application file for complete search history.

(56) References Cited

U.S. PATENT DOCUMENTS 5,063,331 A 11/1991 Nostwick
5,557,249 A * 9/1996 Reynal ..... 336/5
5,841,239 A 11/1998 Sullivan et al.
5,877,592 A * 3/1999 Hesterman et al. ..... 315/106
5,930,126 A 7/1999 Griffin et al.
6,008,587 A * 12/1999 Mills ..... 315/102
6,104,146 A 8/2000 Chou et al.
6,118,228 A 9/2000 Pál
6,310,444 B1 * 10/2001 Chang ..... 315/282
6,717,372 B2 4/2004 Lin et al.
6,781,325 B2 8/2004 Lee
6,922,023 B2 7/2005 Hsu et al.
7,242,147 B2 7/2007 Jin
7,282,868 B2 10/2007 Ushijima et al.
7,294,971 B2 * 11/2007 Jin ..... 315/177
2004/0004450 A1 1/2004 Hsu et al.
2006/0158124 A1 7/2006 Hosaka et al.

* cited by examiner

*Primary Examiner*—Douglas W Owens
*Assistant Examiner*—Ming D A
(74) *Attorney, Agent, or Firm*—Orrick Herrington & Sutcliffe LLP

(57) ABSTRACT

An economical device for lighting lamps such as discharge tubes. The lamp-lighting apparatus has an inverter transformer, a switching circuit connected with the primary winding of the inverter transformer and acting to perform switching for converting a voltage from an input power supply, a shunt transformer connected in series with the secondary winding of the inverter transformer, lamps connected in series with the shunt transformers, and a control circuit for producing a control signal to control the switching performed by the switching circuit based on the voltages at the junctions of the shunt transformer and each of the lamps without directly detecting the voltage applied to the secondary winding of the inverter transformer. The number of protective circuits can be reduced. Consequently, the cost can be reduced.

3 Claims, 13 Drawing Sheets

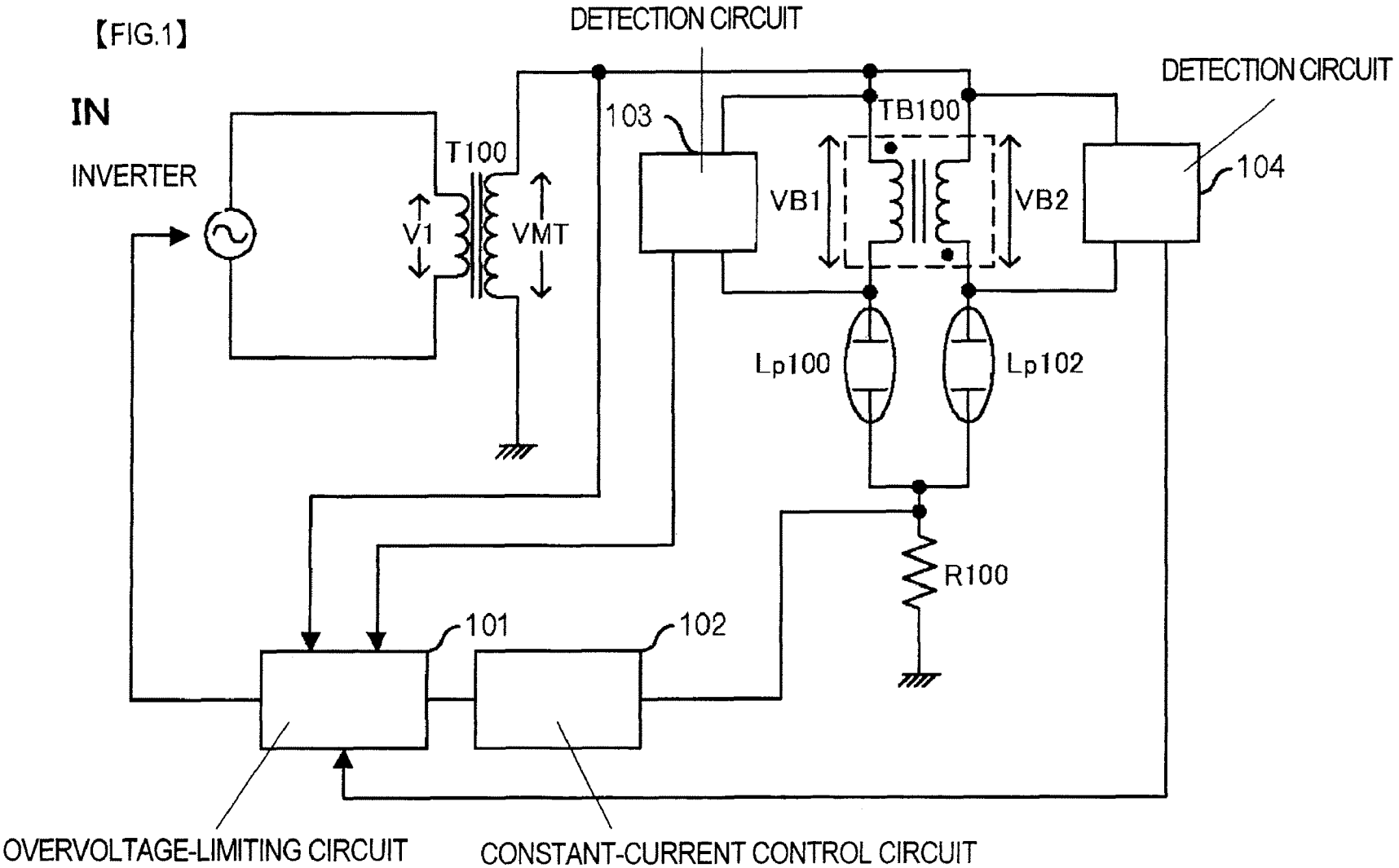
【FIG.1】

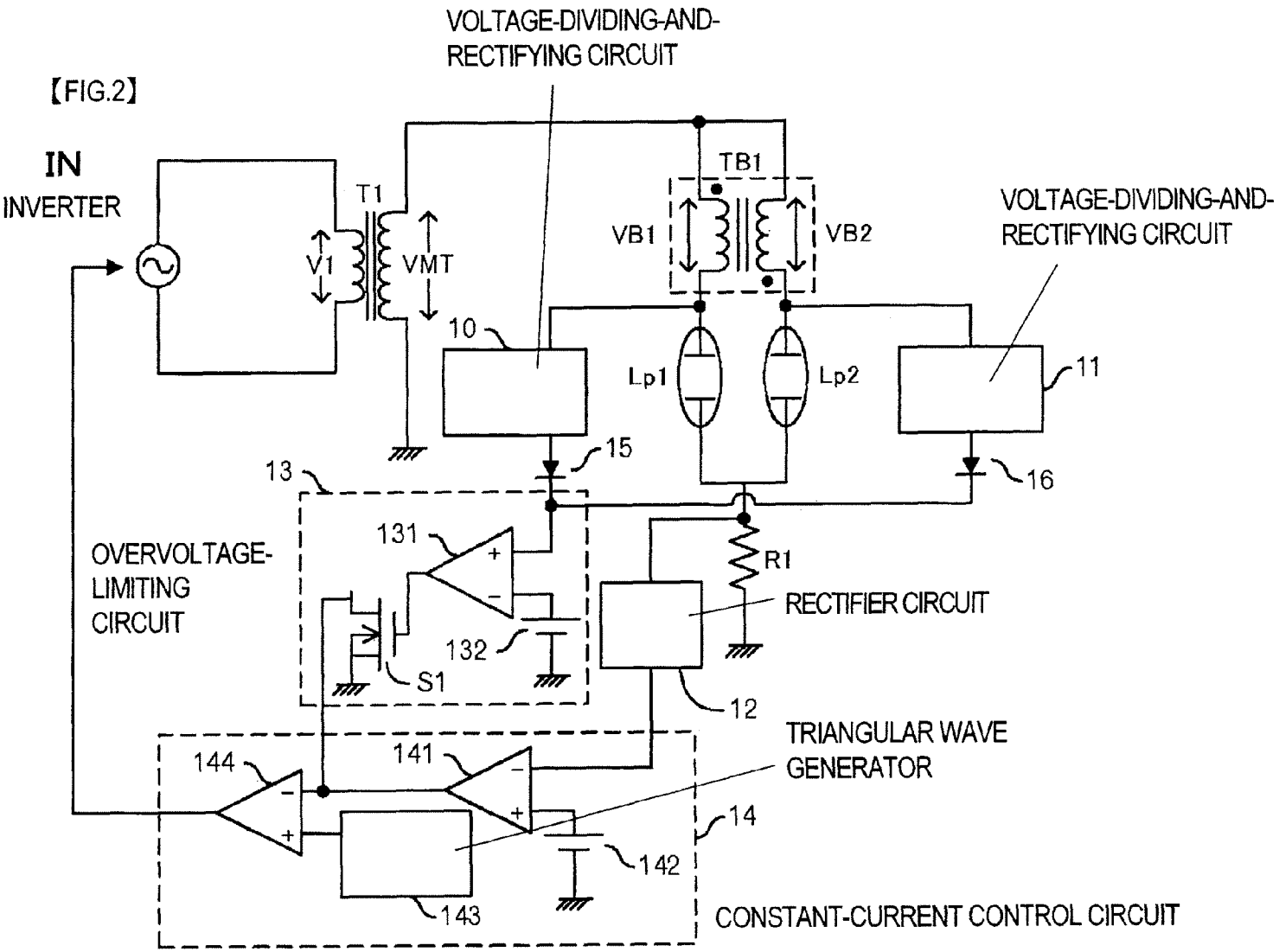
【FIG.2】

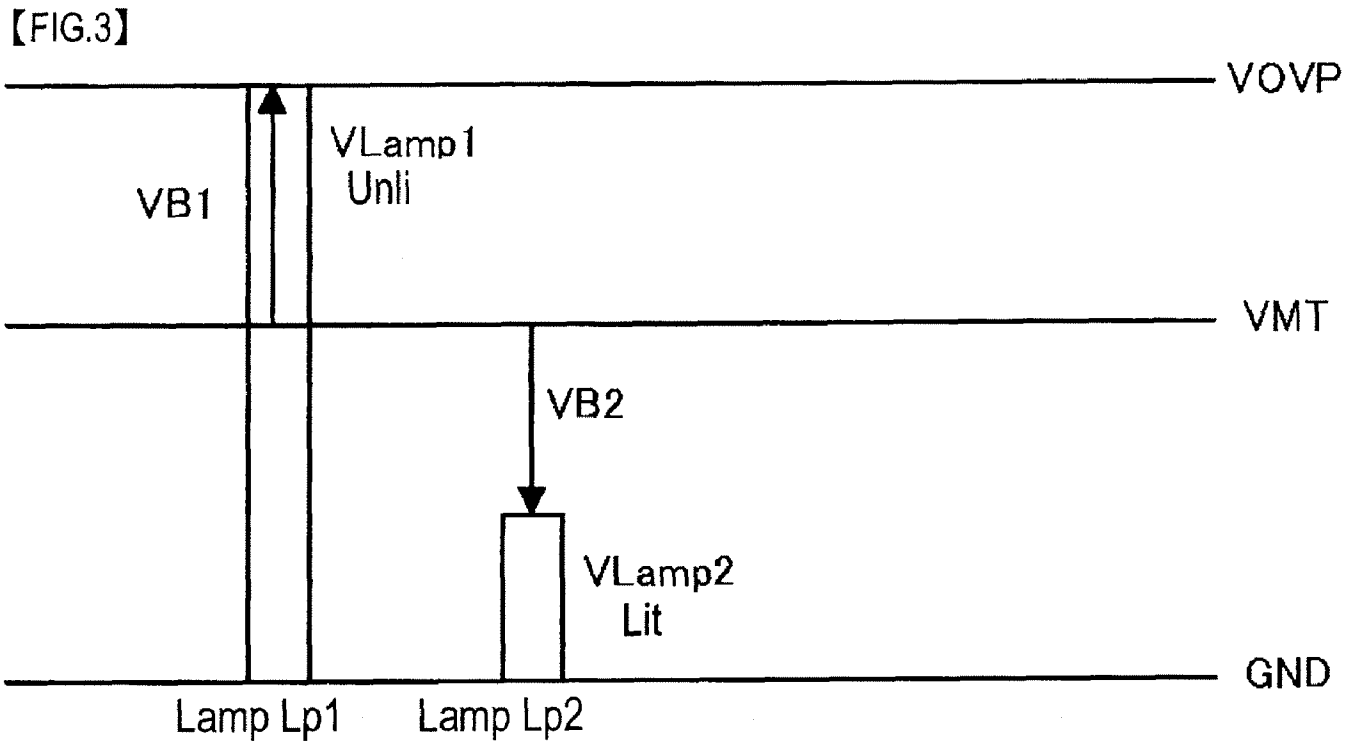
[FIG.3]

【FIG.4】

| | VMT MAXIMUM VALUE | VB MAXIMUM VALUE | VLAMP MAXIMUM VALUE |
|---|---|---|---|
| PRIOR ART | VLAMPSTRIKE | VLAMPSTRIKE | VLAMPSTRIKE + VBmax |
| EMBODIMENT OF THE INVENTION | VLAMPSTRIKE | VLAMPSTRIKE-VLAMPONmin | VLAMPSTRIKE |

【FIG.5】
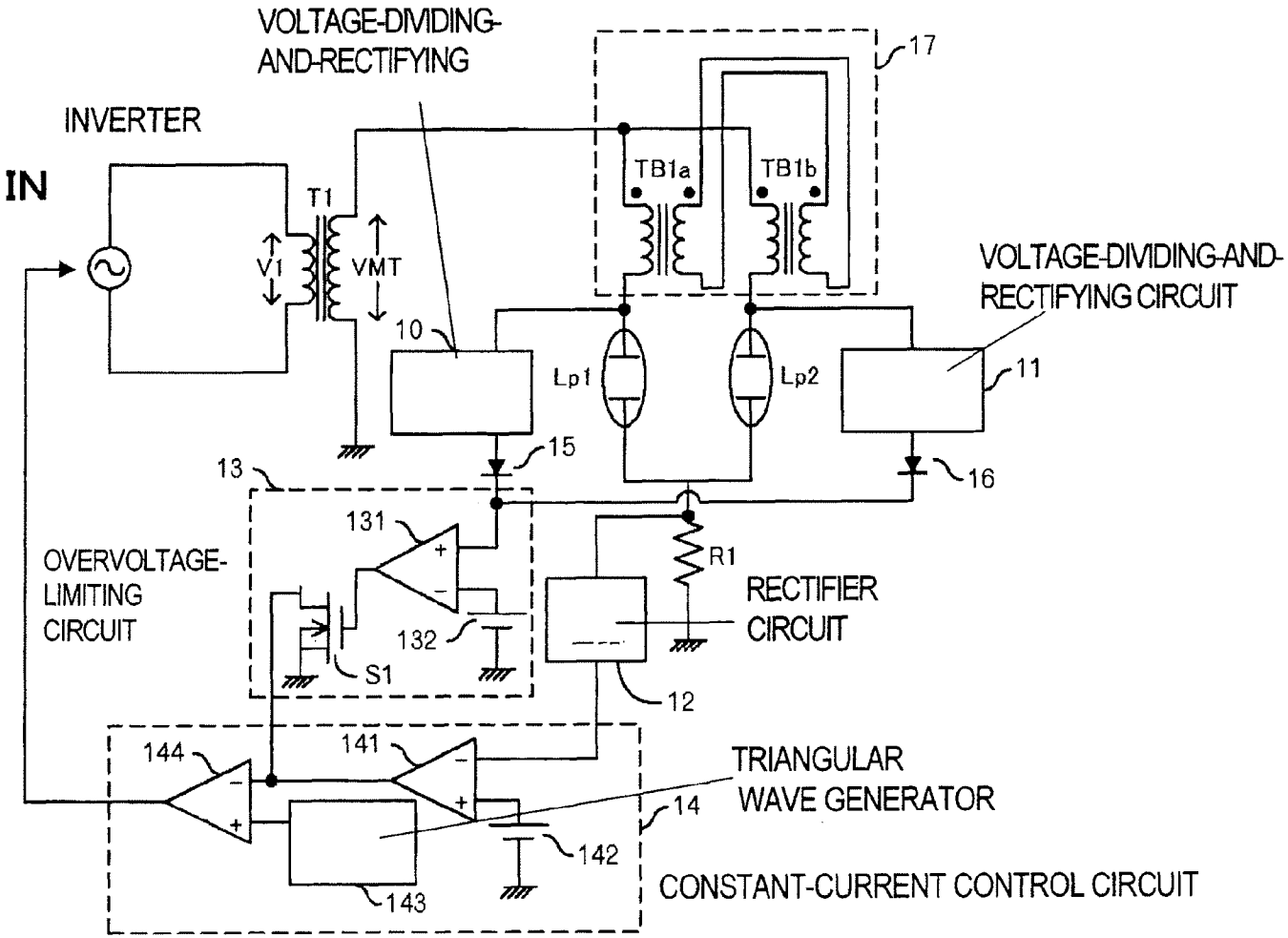

【FIG.6】
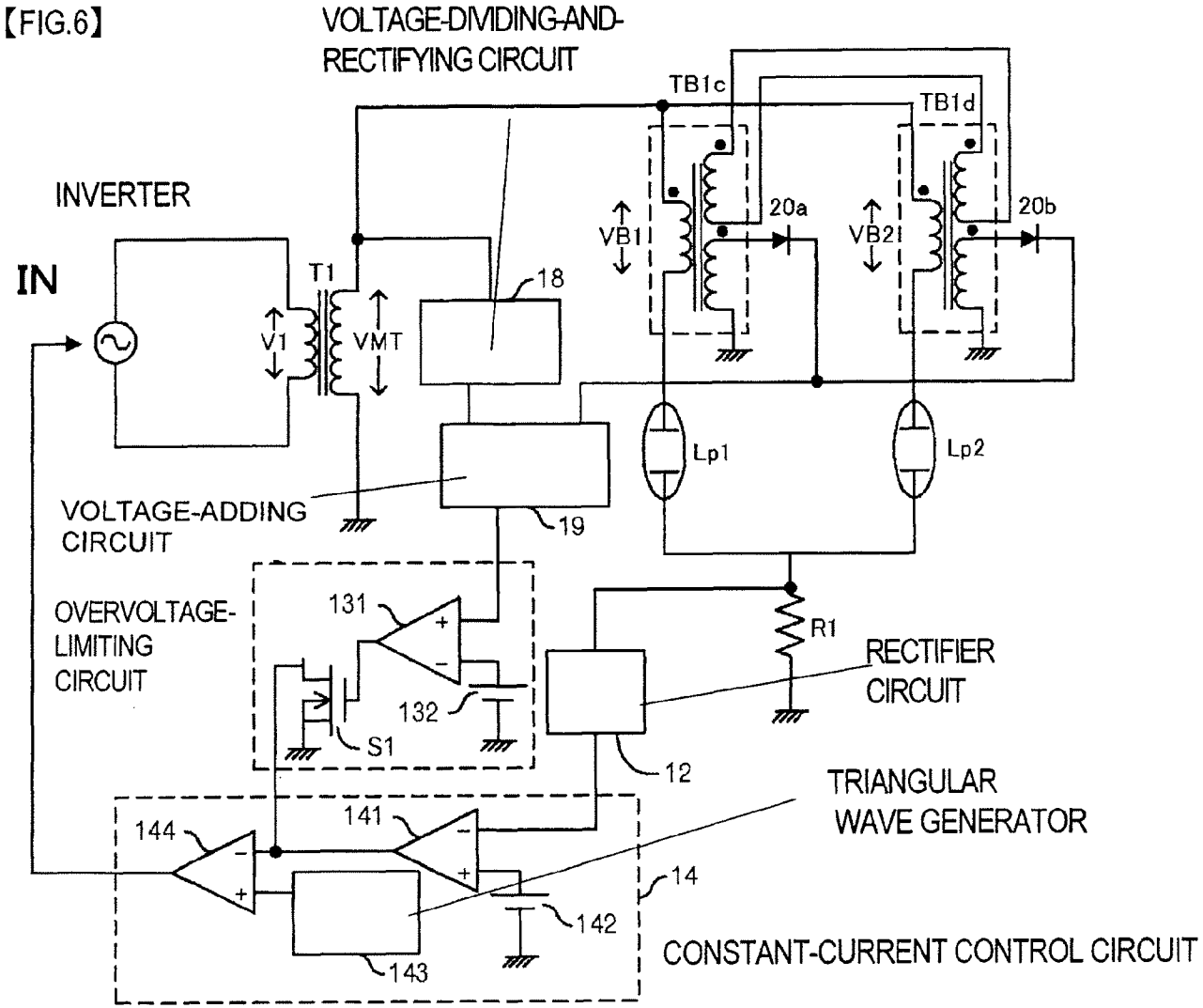

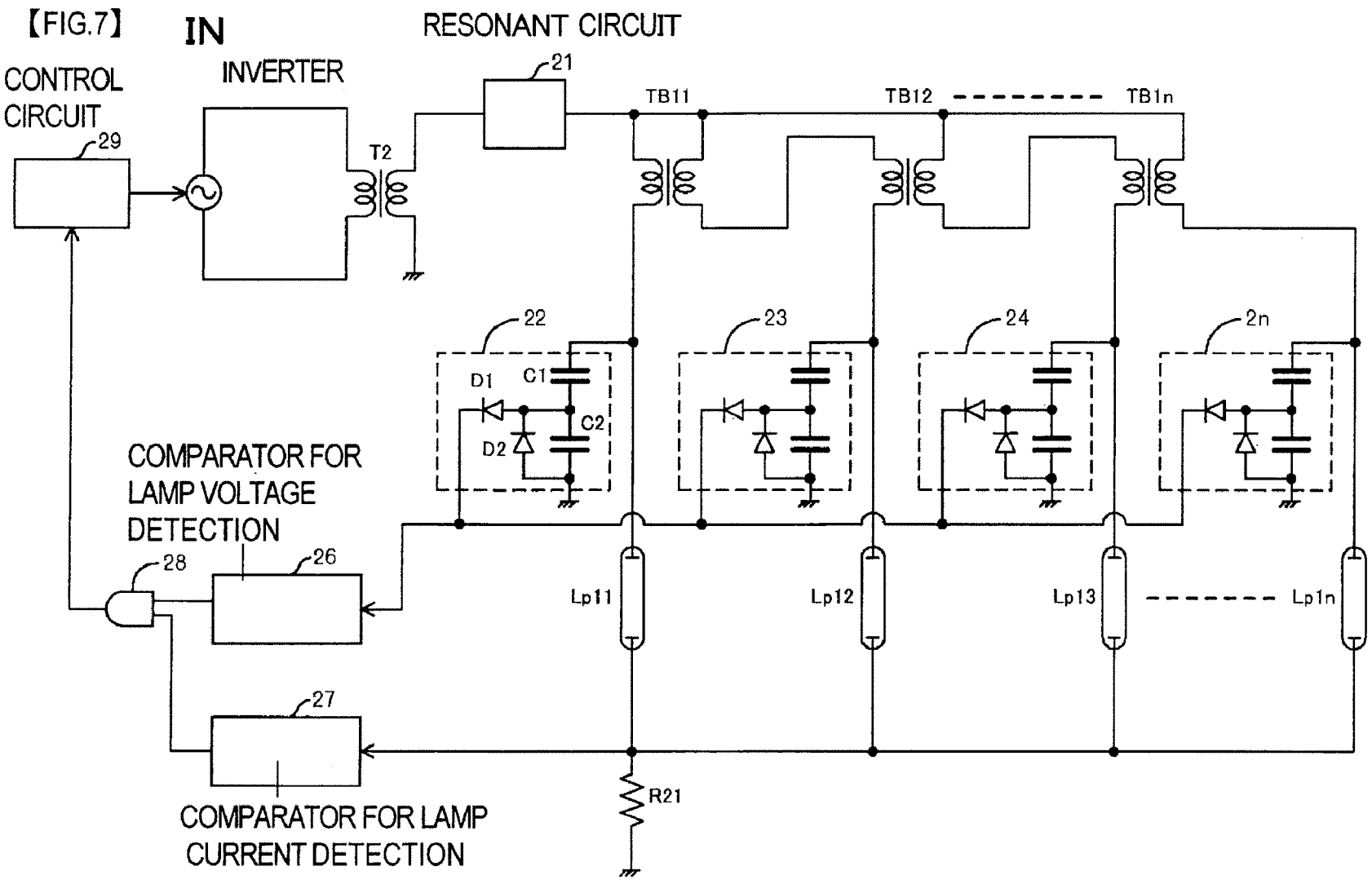
[FIG.7]

【FIG.8】
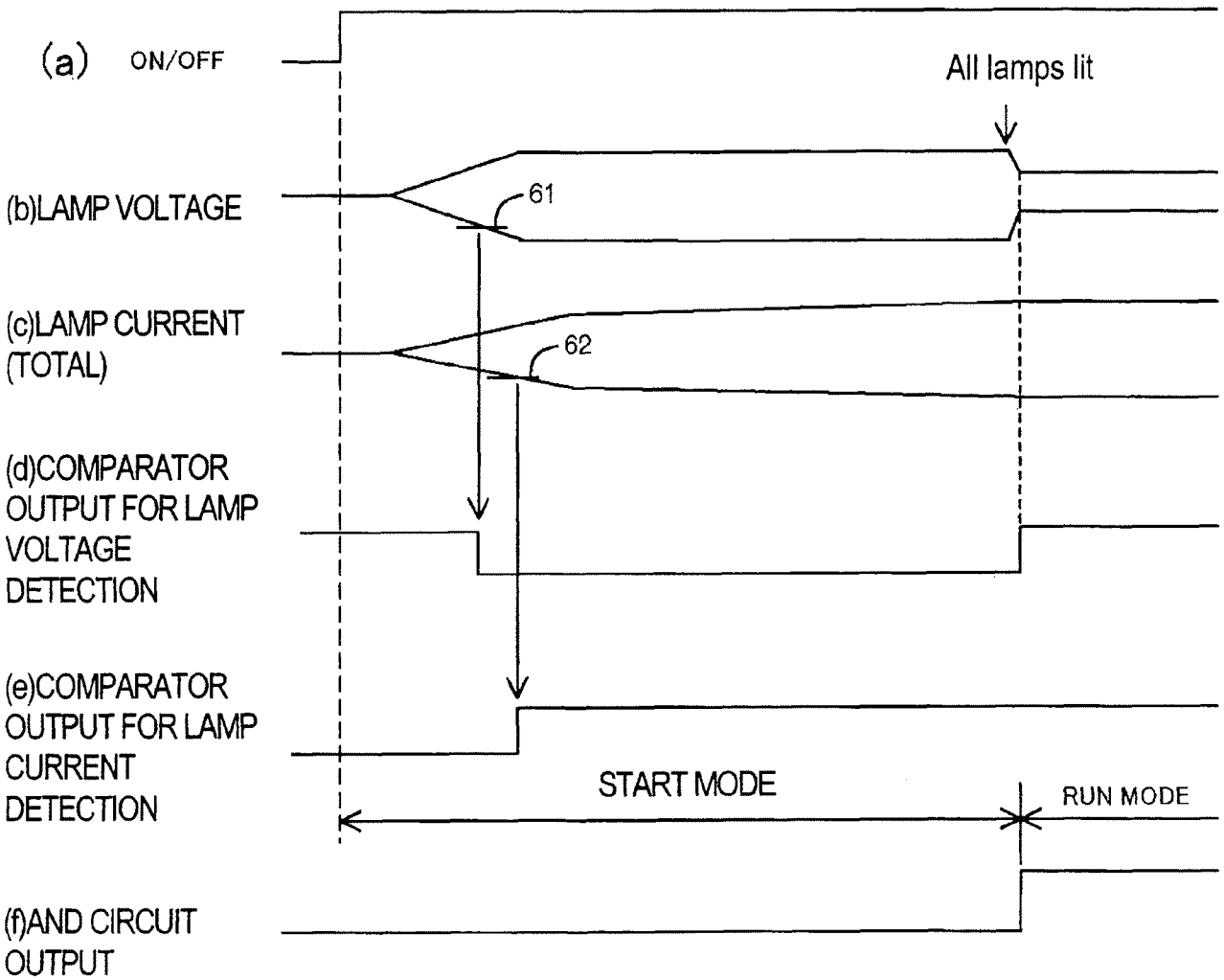

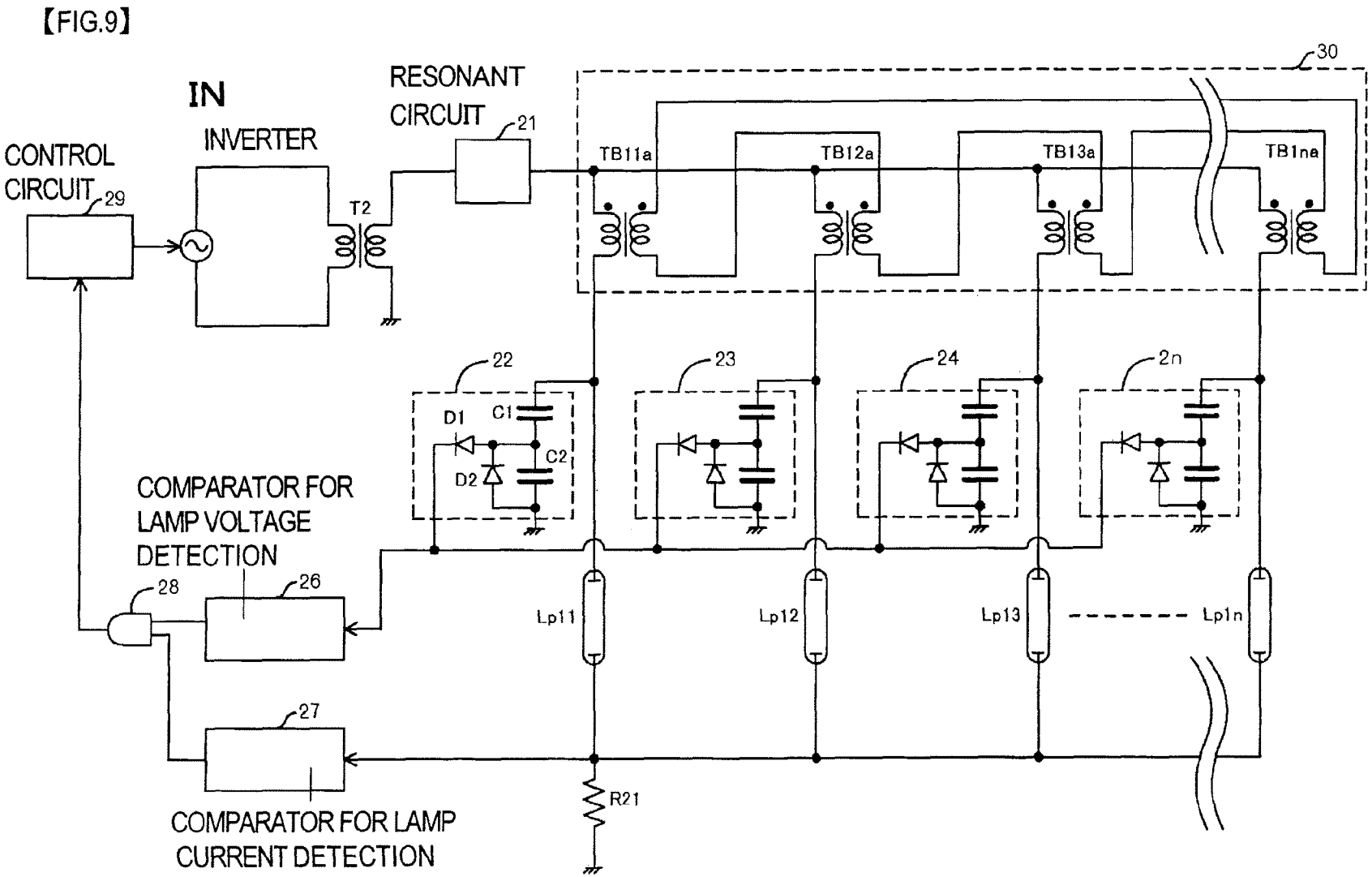
【FIG.9】

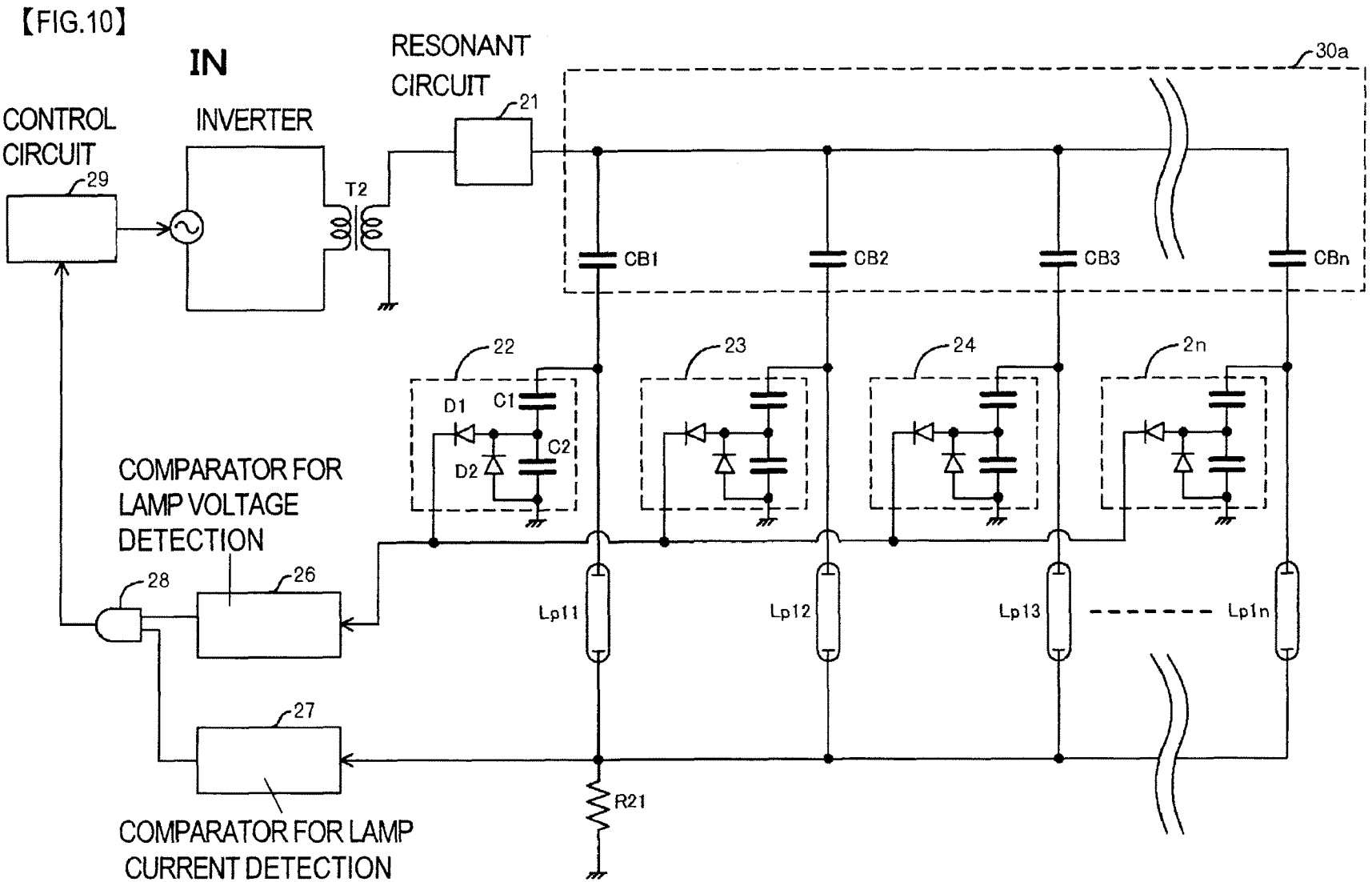
[FIG.10]

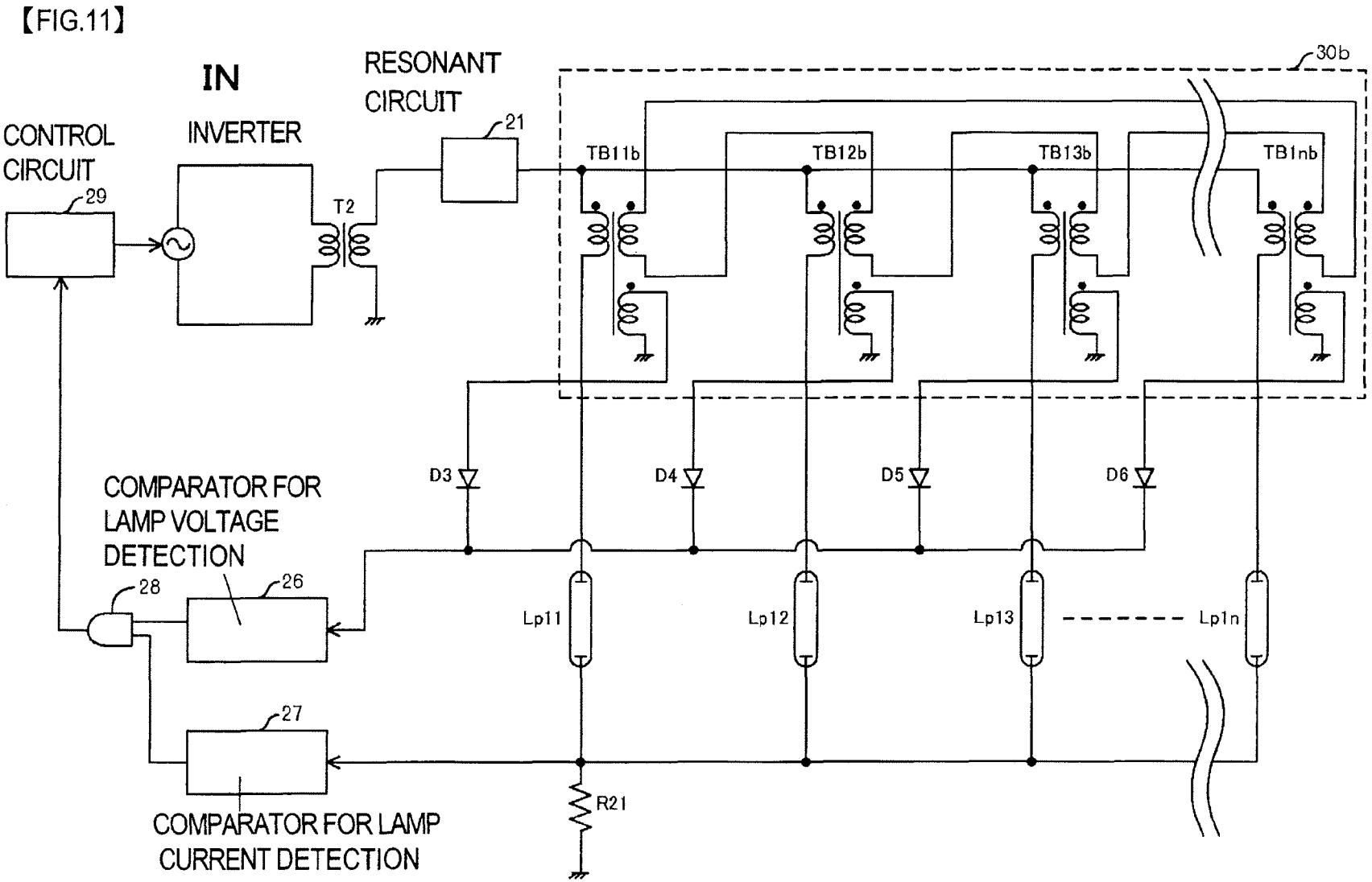
【FIG.11】

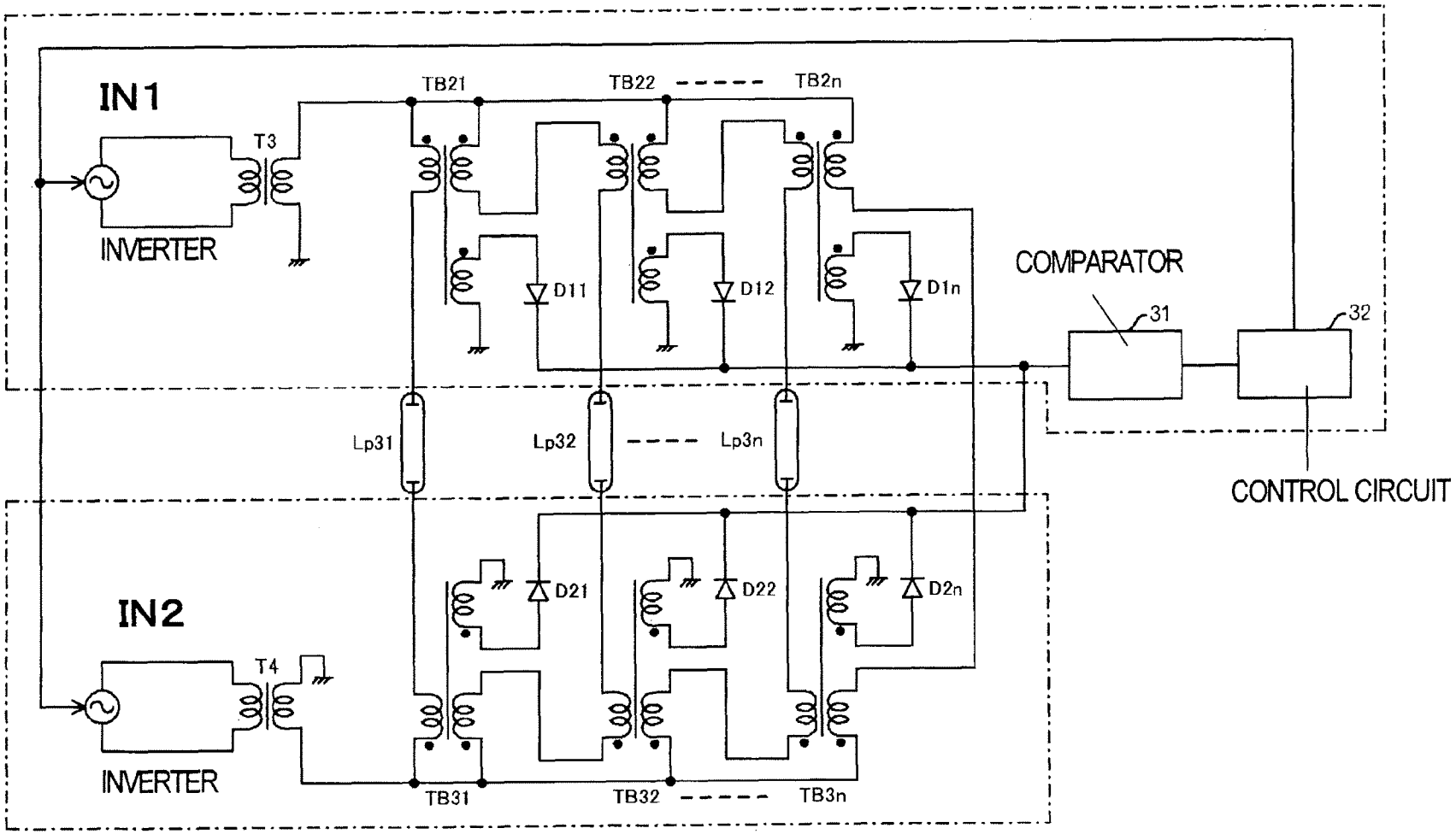
【FIG.12】

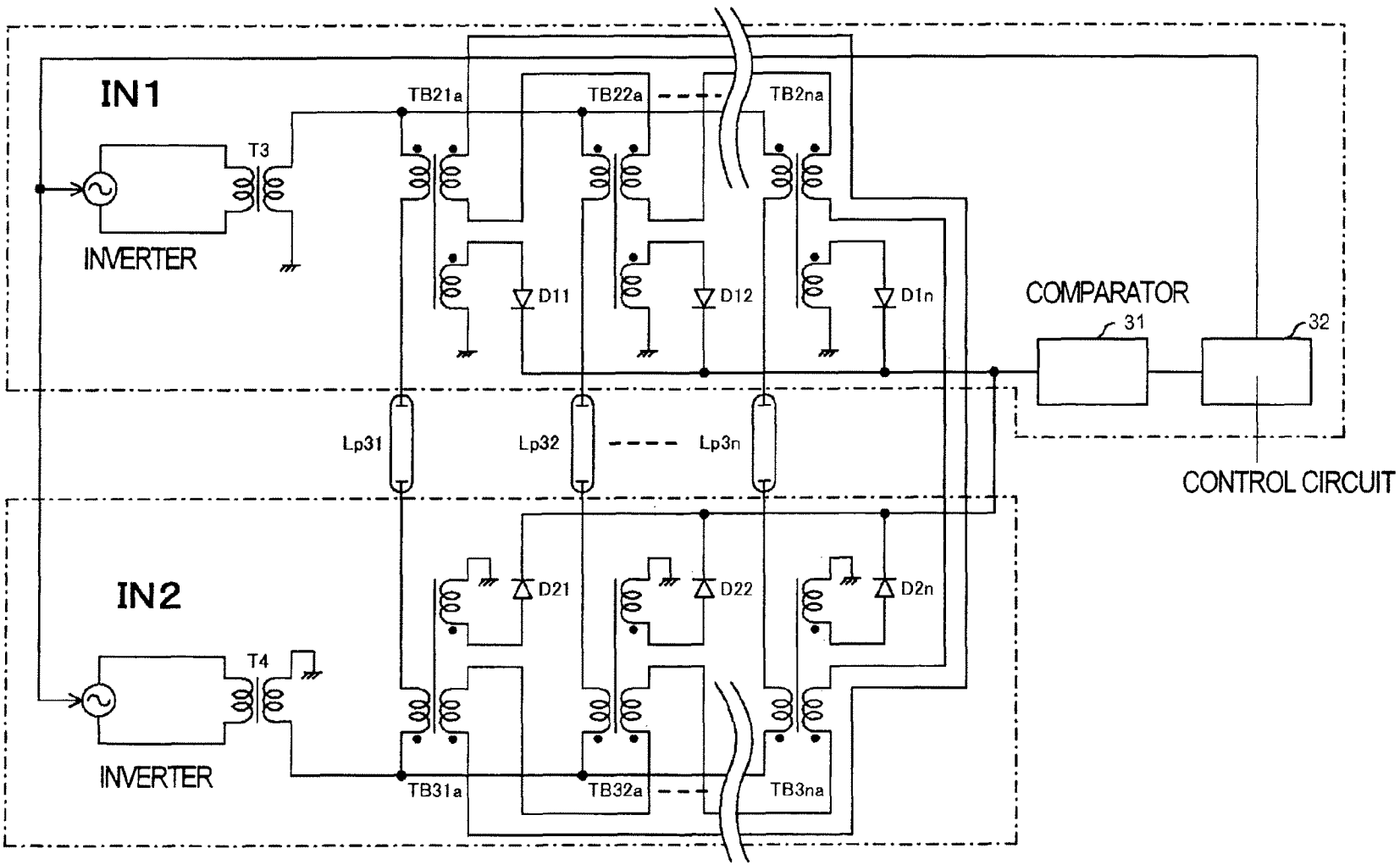
【FIG.13】

LAMP-LIGHTING APPARATUS

CROSS-REFERENCE TO RELATED APPLICATION

This application is a continuation of U.S. application Ser. No. 11/267,007, filed Nov. 4, 2005 now U.S. Pat. No. 7,573,205, and claims priority to Japanese Application Serial No. 2005-218201, filed Jul. 7, 2005 and Japanese Application Serial No. 2004-322302, filed Nov. 5, 2004. all of which are incorporated herein by reference in their entirety.

BACKGROUND OF THE INVENTION

The present invention relates to a lamp-lighting apparatus.

BACKGROUND ART

One example of the prior art discharge tube-lighting device is shown in FIG. 1. In the lighting device of FIG. 1, a voltage V1 is applied across the primary winding of a main transformer T100 by an inverter including a switching circuit. A voltage VMT is induced across the secondary winding of the main transformer T100. One end of the secondary winding of the main transformer T100 is connected to respective one ends of the primary and secondary windings of a shunt transformer (balancer) TB100. The other end of the secondary winding of the main transformer T100 is grounded. One end of a discharge tube Lp100 such as a cold-cathode tube is connected to the other end of the primary winding of the shunt transformer TB100. One end of a discharge tube Lp102 is connected to the other end of the secondary winding of the shunt transformer TB100. The shunt transformer TB100 generates a voltage by a current difference between the primary and second windings in order to suppress variations in currents flowing through the discharge tubes due to variations in characteristics among the tubes and due to differences in starting characteristics among the tubes; otherwise, some discharge tubes would not be lit up. Voltages of reverse polarities are produced to the primary and secondary windings. The other ends of the discharge tubes Lp100 and Lp102 are connected to one end of a resistor R100, the other end of which is grounded.

In the prior art technique, an overvoltage-limiting circuit 101 is used in the discharge tube-lighting device as described above to prevent overvoltage to be applied to the secondary winding of the main transformer T100 and to the primary and secondary windings of the shunt transformer TB100. Also, a constant-current control circuit 102 is used to make uniform the currents flowing through the discharge tubes Lp100 and Lp102. Therefore, the voltage at the junction among the resistor R100 and discharge tubes Lp100, Lp102 is applied to the constant-current control circuit 102. The voltage VMT across the secondary winding of the main transformer T100, the output from a detection circuit 103 for detecting the voltage produced across the primary winding of the shunt transformer TB100, and the output from a detection circuit 104 for detecting the voltage produced across the secondary winding of the shunt transformer TB100 are applied to the overvoltage-limiting circuit 101. Switching of the switching circuit for the inverter is controlled by the output from the overvoltage-limiting circuit 101.

When a discharge tube is started, a high voltage is necessary. Therefore, high voltages are produced across the shunt transformer TB100 and across the main transformer T100. Furthermore, during operation, if any discharge tube is at fault and opened, high voltages are produced across the shunt transformer TB100 and across the main transformer T100. To protect the shunt transformer TB100 and main transformer T100 against dielectric breakdown, the overvoltage-limiting circuit 101, a protective circuit, or a voltage-clamping circuit has been provided, thus limiting the maximum voltages of the shunt transformer TB100 and main transformer T100. In this case, the following problems regarding shape and cost arise.

(1) Two protective circuits are necessary. One is the overvoltage-limiting circuit 101 for the main transformer T100, while the other is formed by the detection circuits 103, 104 and overvoltage-limiting circuit 101 for the shunt transformer TB100.

(2) The voltage produced at the junction of the shunt transformer TB100 and the discharge tube becomes excessively high. Consequently, it is necessary to increase the interconnect pattern spacing, part ratings, and so on excessively.

More specifically, the maximum value VLAMPmax of the voltage VLAMP produced at the junction of the shunt transformer TB100 and the discharge tube is the sum of the maximum value VMTmax of the voltage VMT produced across the secondary winding of the main transformer T100 and the maximum value VBmax of the voltage VB produced across the shunt transformer TB100. That is, VLAMPmax=VMTmax+VBmax. Furthermore, VLAMP is necessary to secure the voltage VLAMPSTRIKE that is necessary to light up the discharge tube. On the other hand, the voltage VB is affected by variations among various discharge tubes and by the characteristics of the shunt transformer TB100. Therefore, it is necessary that the voltage VMT can produce the voltage VLAMPSTRIKE. As a result, there is a possibility that a relationship VLAMPmax=VLAMPSTRIKE+VBmax holds. An interconnect pattern spacing and part ratings withstanding this voltage are necessary.

A circuit similar to the circuit shown in FIG. 1 is disclosed also in US patent application No. 2004-0155596A1.

Furthermore, ring balancers each having plural balancing transformers are disclosed in US patent application Nos. 2005-93471A1 and 2005-93472A1. An electrical current is shared among plural lamps that form a backlight system. The primary windings of the balancing transformers in such a ring balancer are connected in series with their respective lamps. All the secondary windings are connected to form a closed loop. By sharing the electrical current among the secondary windings by the closed loop formed by the secondary windings in this way, the current for energizing the lamps on the primary windings is also shared among the primary windings.

The prior art technique presents problems in terms of cost for the reason described above.

BRIEF SUMMARY OF THE INVENTION

Accordingly, it is an object of the present invention to provide a technique for reducing the cost of a device for lighting a lamp such as a discharge tube.

It is another object of the invention to provide a technique for enhancing the safety of a lamp-lighting apparatus.

It is a further object of the invention to provide a technique for causing a lamp-Lighting apparatus to light up a lamp reliably.

It is a yet other object of the invention to provide a novel technique for making uniform lamps of a lamp-lighting apparatus in brightness.

A lamp-lighting apparatus associated with a first embodiment of the present invention comprises: an inverter transformer having first and secondary windings; a switching circuit connected with the primary winding of the inverter transformer and acting to perform switching for converting a voltage from an input power supply; a balancer connected with the secondary winding of the inverter transformer and acting to make uniform electrical currents flowing through plural lamps; and a control circuit for creating a control signal for controlling switching performed by the switching circuit based on a voltage corresponding to the sum of a voltage produced across the secondary winding of the inverter transformer and a voltage produced across the balancer.

Application of overvoltages to components can be prevented by providing control based on a voltage corresponding to the sum of the voltage produced across the secondary winding of the inverter transformer and the voltage produced across the balancer. This is advantageous for the interconnect pattern and for the costs of parts.

The aforementioned balancer may be connected in series between the secondary winding of the inverter transformer and each lamp. The control circuit may create a control signal for controlling switching performed by the switching circuit based on the potential at the junction of the balancer and the lamp. The voltage at the junction of the balancer and lamp is detected and control is provided without directly detecting the voltage on the secondary winding of the inverter transformer (main transformer) and providing control in this way. The number of protective circuits can be eliminated. In addition, the inverter transformer and balancer can be operated without producing any problems with their breakdown voltages simply by providing such control. Further, the lamps can be lit up more reliably.

The balancer described above may be provided for each lamp. A first detection circuit for detecting a voltage corresponding to the voltage produced across the secondary winding of the inverter transformer, a second detection circuit for detecting a voltage corresponding to a maximum one of voltages produced across portions of the balancer which are in charge of the lamps, respectively, and a circuit for adding up the output voltage from the first detection circuit and the output voltage from the second detection circuit may be added. This configuration copes with a case, for example, where the voltage at the junction of the balancer and each lamp cannot be directly detected.

Additionally, the balancer described above may have plural transformers. The primary winding of each transformer may be connected in series between a corresponding one of the lamps and the secondary winding of the inverter transformer. The secondary winding of each transformer and the secondary windings of other transformers may be connected to form a closed loop. Moreover, each of the above-described transformers may have a tertiary winding across which a voltage corresponding to the voltage produced across the primary winding is produced.

A lamp-lighting apparatus associated with a second embodiment of the present invention comprises: an inverter transformer having primary and secondary windings; a switching circuit connected to the primary winding of the inverter transformer and acting to perform switching for converting a voltage from an input power supply; a balancer connected with the secondary winding of the inverter transformer and acting to make uniform electrical currents flowing through plural lamps; and a control circuit for creating a control signal for controlling the switching performed by the switching circuit based on a voltage produced across the balancer. The balancer includes a transformer having a tertiary winding. The voltage produced across the balancer is detected from the tertiary winding. Consequently, even where no voltage-dividing capacitor can be disposed to avoid electric discharging or for other reason, a voltage corresponding to the primary winding is detected and the lamp-lighting apparatus can be controlled based on the detected voltage because of the configuration described above.

A lamp-lighting apparatus associated with a third embodiment of the present invention comprises: an inverter transformer having primary and secondary windings; a switching circuit connected to the primary winding of the inverter transformer and acting to perform switching for converting a voltage from an input power supply; a balancer connected with the secondary winding of the inverter transformer and acting to make uniform electrical currents flowing through plural lamps; and a control circuit. The control circuit detects that all the lamps have lit up, based on a maximum one of voltages corresponding to voltages detected via the balancer and applied to the plural lamps and based on electrical currents flowing through the lamps, and creates a control signal for ending a start mode activated under conditions different from conditions under which normal operation is performed. The control signal is output to the switching circuit. The start mode activated under conditions different from conditions under which normal operation is performed is operated at the resonant frequency of a resonant circuit formed, for example, on the secondary winding side of the inverter transformer. Because of this configuration, the end of the start mode can be judged appropriately.

The control circuit may include a circuit for detecting that, as a maximum one of voltages corresponding to voltages applied to the plural lamps, a maximum one of voltages produced at the junctions of the portions of the balancer which are in charge of the lamps, respectively, and the lamps in the balancer is lower than a given voltage and that the sum of the currents flowing through the lamps is higher than a given level.

The balancer may have plural transformers. The primary winding of each transformer may be connected in series with a corresponding one of the lamps and the secondary winding of the inverter transformer. The secondary winding of this transformer and the secondary windings of the other transformers may be connected to form a closed loop.

A lamp-lighting apparatus associated with a fourth embodiment of the present invention comprises: one or more inverter transformers; a first balancer including a first transformer having a primary winding connected with the secondary winding or windings of the one or more inverter transformers and with one end of a certain one of plural lamps, the first balancer acting to make uniform electrical currents flowing through the plural lamps; a second balancer including a second transformer having a primary winding connected with the secondary winding or windings of the one or more inverter transformers and with the other end of the certain one of the plural lamps, the second balancer acting to make uniform the currents flowing through the plural lamps; and means for supplying 180 degree out-of-phase voltages to opposite ends of each of the lamps. There is a location in which the secondary winding of the first transformer and the secondary winding of the second transformer are connected in series. The currents flowing through the opposite ends of each lamp are made uniform by the first and second balancers in this way. Consequently, the plural lamps can be made uniform in brightness.

Additionally, plural first transformers and plural second transformers may be equipped. The secondary windings of the first transformers may be connected in series in a heteropolar relation. The secondary windings of the second transformers may be connected in series in a heteropolar relation. The secondary winding of at least one of the first transformers and the secondary winding of at least one of the second transformers may be connected in series in a homopolar relation.

The above-described first balancer may have plural first transformers. The primary winding of each first transformer may be connected in series with a corresponding one of the lamps and with the secondary winding or windings of the one or more inverter transformers. The secondary winding of any one of the first transformers may be connected with a terminal with a different polarity of the secondary winding of any other first transformer in the first balancer. In addition, the second balancer may have plural second transformers. The primary windings of the second transformers may be connected in series with a corresponding one of the lamps and with the secondary winding or windings of the one or more inverter transformers. The secondary winding of any one second transformer may be connected with a terminal with a different polarity of the secondary winding of any other second transformer in the second balancer. The secondary windings of the transformers in the first balancer and the secondary windings of the transformers in the second balancer may be connected to form a closed loop.

A lamp-lighting apparatus associated with a fifth embodiment of the present invention comprises: a first inverter transformer having primary and secondary windings; a first switching circuit connected with the primary winding of the first inverter transformer and acting to perform switching for converting a voltage from a first input power supply; a first balancer connected with the secondary winding of the first inverter transformer and with respective one ends of plural lamps and acting to make uniform electrical currents flowing through the lamps; a second inverter transformer having primary and secondary windings; a second switching circuit connected with the primary winding of the second inverter transformer and acting to perform switching for converting a voltage from a second input power supply into a phase that is 180 degree out-of-phase with the output from the first inverter transformer; a second balancer connected with the secondary winding of the second inverter transformer and with the other ends of the plural lamps and acting to make uniform electrical currents flowing through the plural lamps; a detection circuit for detecting the currents flowing through the lamps; and a control circuit for stopping the switching performed by the first and second switching circuits or limiting the currents in a case where the detection circuit has detected that any current flowing through a corresponding one of the lamps has varied by more than a given level. The first and second balancers are connected.

That any current flowing through the corresponding lamp has varied by more than a given level means that the lamp is at fault or the inverter transformer has presented a problem. Therefore, the operation is stopped or the current is limited, thus securing safety.

The techniques of the lamp-lighting circuits associated with the first through fifth embodiments described above can be combined arbitrarily.

There exist plural circuits for achieving the configuration described so far. While specific examples thereof are given below, the invention is not limited thereto.

According to the present invention, the cost of a device for lighting a lamp such as a discharge tube can be reduced.

In another aspect of the invention, the safety of the lamp-lighting apparatus can be enhanced.

In a further aspect of the invention, lamps can be reliably lit up efficiently in a lamp-lighting apparatus.

In a yet other aspect of the invention, lamps in a lamp-lighting apparatus can be made uniform in brightness.

BRIEF DESCRIPTION OF THE DRAWINGS

FIG. 1 is a diagram of a conventional lamp-lighting circuit;

FIG. 2 is a diagram of a lamp-lighting circuit according to a first embodiment of the present invention;

FIG. 3 is a diagram illustrating the principle of the first embodiment of the invention;

FIG. 4 is a diagram illustrating the advantages of the first embodiment of the invention;

FIG. 5 is a diagram of a lamp-lighting circuit according to a second embodiment of the invention;

FIG. 6 is a diagram of a lamp-lighting circuit according to a third embodiment of the invention;

FIG. 7 is a diagram of a lamp-lighting circuit according to a fourth embodiment of the invention;

FIG. 8 ((*a*)-(*f*)) is a signal waveform diagram illustrating the operation of a lamp-Lighting circuit according to the fourth embodiment of the invention;

FIG. 9 is a diagram of a lamp-lighting circuit according to a fifth embodiment of the invention;

FIG. 10 is a diagram showing a lamp-lighting circuit according to a sixth embodiment of the invention;

FIG. 11 is a diagram showing a lamp-lighting circuit according to a seventh embodiment of the invention;

FIG. 12 is a diagram showing a lamp-lighting circuit according to an eighth embodiment of the invention; and FIG. 13 is a diagram showing a lamp-lighting circuit according to a ninth embodiment of the invention.

DETAILED DESCRIPTION OF THE INVENTION

A. First Embodiment

An example of circuit of a lamp-lighting apparatus associated with a first embodiment of the present invention is shown in FIG. 2. This lamp-lighting apparatus has an inverter including a switching circuit, an inverter transformer (main transformer) T1, a shunt transformer (balancer) TB1, lamps Lp1 and Lp2 such as cold-cathode tubes, a resistor R1, voltage-dividing-and-rectifying circuits 10 and 11, a rectifier circuit 12, an overvoltage-limiting circuit 13, a constant-current control circuit 14, and diodes 15, 16. The overvoltage-limiting circuit 13 has a comparator 131, a first reference voltage source 132, and a MOSFET S1. The constant-current control circuit 14 has comparators 141, 144, a second reference voltage source 142, and a triangular wave generator 143.

The inverter is connected with the primary winding of the inverter transformer T1. A voltage V1 is applied to the primary winding of the inverter transformer T1. A voltage VMT is produced across the secondary winding of the inverter transformer T1. One end of the secondary winding of the inverter transformer T1 is connected with one end of the primary winding of the shunt transformer TB1 and with one end of the secondary winding. The other end of the secondary winding of the inverter transformer T1 is grounded. The other end of the primary winding of the shunt transformer TB1 is connected with one end of the lamp Lp1. The other end of the secondary winding of the shunt transformer TB1 is connected with one end of the lamp Lp2. The other end of the lamp Lp1 and the other end of the lamp Lp2 are connected with one end of the resistor R1, the other end of the resistor R1 being grounded. Let VB1 be the voltage on the primary winding side of the shunt transformer TB1. Let VB2 be the voltage on the secondary winding side. The shunt transformer TB1 is so used that the primary and secondary windings have opposite polarities.

The junction of the primary winding of the shunt transformer TB1 and the lamp Lp1 is connected with the voltage-dividing-and-rectifying circuit 10, which in turn is connected with the overvoltage-limiting circuit 13 via the diode 15. The junction of the secondary winding of the shunt transformer TB1 and the lamp Lp2 is connected with the voltage-dividing-and-rectifying circuit 11, which in turn is connected with the overvoltage-limiting circuit 13 via the diode 16. The junction among the lamps Lp1, Lp2 and resistor R1 is connected with the rectifier circuit 12, which in turn is connected with the constant-current control circuit 14.

In the overcurrent-limiting circuit 13, the outputs from the voltage-dividing-and-rectifying circuits 10 and 11 are applied to the positive input terminal of the comparator 131 via the diodes 15 and 16, respectively. The positive terminal of the reference voltage source 132 is connected with the negative input terminal of the comparator 131. The negative terminal of the reference voltage source 132 is grounded. The output of the comparator 131 is connected with the gate of the MOSFET S1. The source of the MOSFET S1 is grounded. The drain is connected with the negative input terminal of the comparator 144 within the constant-current control circuit 14. The output of the rectifier circuit 12 is connected with the negative input terminal of the comparator 141 inside the constant-current control circuit 14. The positive terminal of the reference voltage source 142 is connected with the positive input terminal of the comparator 141. The negative terminal of the reference voltage source 142 is grounded. The output of the comparator 141 is connected with the negative input terminal of the comparator 144. The triangular wave generator 143 is connected with the positive input terminal of the comparator 144. The output from the comparator 144 is input to the inverter including the switching circuit, so that the duty factor of the switching circuit is varied.

The operation of the lamp-lighting apparatus shown in FIG. 2 is described briefly. The voltage V1 applied to the primary winding of the inverter transformer T1 by the output from the inverter turns into the voltage VMT on the secondary winding side. The voltage VMT is stepped up or down by the shunt transformer TB1 and applied to the lamps LP1 and LP2. The shunt transformer operates in the same way as in the prior art. A voltage is produced by a current difference between the primary and secondary windings in order to suppress variations between the currents flowing through the lamps due to variations in characteristics between the lamps and to prevent the lamps from being unlit due to differences in starting characteristics between the lamps. More specifically, as shown in FIG. 3, it is assumed that the lamp Lp1 is not lit while the lamp Lp2 is being lit. A voltage Vlamp1 (=VMT+VB1) higher than the voltage VMT is applied to the lamp Lp1 and a voltage Vlamp2 (=VMT+VB2) lower than the voltage VMT is applied to the lamp Lp2 by the shunt transformer TB1. The voltage VB2 has a negative value. In the example of FIG. 2, there are only two lamps and therefore, VB1+VB2=0. In the example of FIG. 2, the relationship, VOVP=VMT+VB1=VMT−VB2, holds.

The overvoltage-limiting circuit 13 compares a higher one of the voltage at the junction of the shunt transformer TB1 and the lamp Lp1 and the voltage at the junction of the shunt transformer TB1 and the lamp Lp2 with the output voltage from the reference voltage source 132 (target voltage to which the voltage is to be adjusted). Where the higher one of the voltages at the junctions is equal to or more than the output voltage from the reference voltage source 132, the output of the MOSFET S1 is turned on. The negative input terminal of the comparator 131 within the overvoltage-limiting circuit 13 is connected with the ground. On the other hand, where the higher one of the voltages at the junctions is lower than the output voltage from the reference voltage source 132, the output of the MOSFET S1 is turned off. The output from the comparator 131 inside the overvoltage-limiting circuit 13 is intact output to the negative input terminal of the comparator 144. In the constant-current control circuit 14, the electrical currents flowing through the lamps Lp1 and Lp2 are taken out by the resistor R1 and fed into the comparator 141, where the currents are compared with the output voltage from the reference voltage source 142. If the currents flowing through the lamps Lp1 and Lp2 are lower than a reference value, the output from the comparator 141 is increased. A control signal for lengthening the on duty period is created in comparing with the triangular wave in the comparator 144. That is, the currents flowing through the lamps are controlled constant by the overvoltage-limiting circuits 13 and the constant-current control circuit 14. At the same time, the voltage at the junction of the shunt transformer TB1 and the lamp Lp1 and the voltage at the junction of the transformer TB1 and the lamp Lp2 are controlled lower than a given voltage VOVP (maximum value VLAMPSTRIKE of the lighting voltage to which a necessary margin may or may not be added).

FIGS. 2 and 3 are now discussed in detail. We have $$VMT+VB\text{max} \leqq VOVP \tag{1}$$

where VBmax is a maximum voltage having a positive value out of voltages applied to the shunt transformer.

$$VMT+VB\text{min}=V\text{LAMPONmin} \tag{2}$$

where VLAMPONmin is a minimum value of voltages for energizing lamps in a case where there are the plural lamps lit up, and VBmin is a minimum voltage having a negative value out of the voltages applied to the shunt transformer.

$$VB1+VB2=0 \tag{3}$$

From Eq. (1), we have $$VMT \leqq VOVP-VB\text{max} \tag{1'}$$

From Eq. (3), we have $$\text{VMT} \leqq \text{VOVP} \tag{4}$$

because VBmax>0 (or only the relationship that all the values of VB's=0 holds).

Accordingly, with respect to the inverter transformer T1, if it has a breakdown voltage exceeding VOVP, no problems take place.

Furthermore, from Eq. (2), we have $$VMT=V\text{LAMPONmin}-VB\text{min} \tag{2'}$$

From Eq. (3), we have VBmin<0. Therefore, $$\text{VMT}>\text{VLAMPONmin} \tag{5}$$

If the voltage VMT is lower than this, all the lamps are put out.

In addition, from Eq. (1), we have $$VB\text{max} \leqq VOVP-VMT \tag{1''}$$

From Eq. (5), we have $$VB\text{max} \leqq VOVP-V\text{LAMPONmin} \tag{6}$$

From Eq. (2), we have $$VB\text{min}=V\text{LAMPONmin}-VMT$$

Taking the absolute values of both sides results in $$|VB\text{min}|=VMT-V\text{LAMPONmin} \quad (2)''$$

From Eq. (4), we have $$|VB\text{min}|\leqq VOVP-V\text{LAMPONmin} \quad (7)$$

It can be seen from Eqs. (6) and (7) that if the withstand voltage of the shunt transformer TB1 is more than (VOVP−VLAMPONmin), then there is no problem.

Let VLAMPSTRIKE be a maximum value of the lighting voltage of lamps. The situation is summarized as shown in FIG. 4. That is, in the prior art, the maximum value of the voltage VMT created on the secondary winding side of the inverter transformer T1 is VLAMPSTRIKE, while the maximum value of the voltage applied to the shunt transformer TB1 is VBmax. The maximum value of the voltage at the junction of the shunt transformer TB1 and the lamp is VLAMPSTRIKE+VBmax. According to the present embodiment, the maximum value of the voltage VMT produced on the secondary winding side of the inverter transformer T1 is VLAMPSTRIKE. The maximum value of the voltage applied to the shunt transformer TB1 is VLAMPSTRIKE−VLAMPONmin. The maximum value of the voltage at the junction of the shunt transformer TB1 and the lamp is VLAMPSTRIKE. Therefore, the voltage at the junction of the shunt transformer TB1 and lamp is lower than that of conventional one. Since the withstand voltage can be lowered, inexpensive transformers can be used. Furthermore, safety issues such as electrical discharging to the interconnect pattern on a substrate can be reduced. That is, this is more advantageous for routing on interconnect patterns. In the example described above, there are one shunt transformer and two lamps. The invention can also be applied to a case where plural lamps are lit up by plural shunt transformers. For example, in a case where N lamps are lit up with N shunt transformers, Eq. (3) is expanded as follows:

$$VB1+VB2+\ldots+VBN=0$$

However, the result is substantially the same as the foregoing result.

In this way, in the present embodiment, voltage (VMT+VBmax) is detected at the junction of the shunt transformer TB1 and the lamp Lp1 or Lp2. The voltage (VMT+VBmax) at the junction is controlled lower than a given voltage (maximum value VLAMPSTRIKE of the lighting voltage to which a necessary margin may or may not be added). This simplifies the control operation. The withstand voltage of the transformer can be lowered.

B. Second Embodiment

An example of circuit of a lamp-lighting apparatus associated with a second embodiment of the present invention is shown in FIG. 5. This lamp-lighting apparatus associated with the second embodiment is a modification of the lamp-lighting apparatus associated with the first embodiment and similar to the first embodiment except that the balancer 17 of FIG. 5 is different from the balancer of the first embodiment. The balancer 17 includes transformers TB1*a* and TB1*b* which produce voltages on the secondary winding side such that the voltages on the primary and secondary sides are in phase. A first terminal of the primary winding of the transformer TB1*a* is connected with a first terminal of the secondary winding of the inverter transformer T1. A second terminal of the primary winding of the transformer TB1*a* is connected with the first terminal of the lamp Lp1 and with the input terminal of the voltage-dividing-and-rectifying circuit 10. Similarly, a first terminal of the primary winding of the transformer TB1*b* is connected with the first terminal of the secondary winding of the inverter transformer T1. A secondary terminal of the primary winding of the transformer TB1*b* is connected with the first terminal of the lamp Lp2 and with the input terminal of the voltage-dividing-and-rectifying circuit 11. A first terminal of the secondary winding of the transformer TB1*a* is connected with a second terminal of the secondary winding of the transformer TB1*b*. The first terminal of the secondary winding of the transformer TB1*b* is connected with a second terminal of the secondary winding of the transformer TB1*a*. That is, with respect to the secondary windings of the transformers TB1*a* and TB1*b*, terminals of different polarities are connected to form a closed loop. Consequently, the same current flows through the secondary windings of the transformers TB1*a* and TB1*b*. Therefore, energizing currents which flow through the primary windings of the transformers TB1*a* and TB1*b* to energize the lamps Lp1 and Lp2, respectively, are made identical. That is, the lamps LP1 and Lp2 are made uniform in brightness.

The portions other than the balancer 17 are identical in configuration and operation with their counterparts of the first embodiment and so their description is omitted.

C. Third Embodiment

An example of circuit of a lamp-lighting apparatus associated with a third embodiment of the present invention is shown in FIG. 6. This lamp-lighting apparatus associated with the third embodiment is a modification of the lamp-lighting apparatus associated with the first or second embodiment. In the present embodiment, the primary windings of transformers TB1*c* and TB1*d* are connected with the lamps. The secondary windings form a closed loop. The transformers further include tertiary windings to detect voltages produced on the primary windings. The transformers TB1*c*, TB1*d*, diodes 20*a*, 20*b* connected with the tertiary windings of the transformers TB1*c*, TB1*d*, a voltage-dividing-and-rectifying circuit 18, and a voltage-adding circuit 19 are mounted instead of the shunt transformer TB1 of FIG. 2 or instead of the balancer 17, the voltage-dividing-and-rectifying circuits 10, 11 and the diodes 15, 16 of FIG. 5. The transformers TB1*c* and TB1*d* produce voltages on the secondary and tertiary windings such that the produced voltages are in phase with the voltages on the primary windings.

A first terminal of the primary winding of the transformer TB1*c* is connected with a first terminal of the secondary winding of the transformer T1. A second terminal of the primary winding of the transformer TB1*c* is connected with a first terminal of the lamp Lp1. A first terminal of the primary winding of the transformer TB1*d* is connected with the first terminal of the secondary winding of the transformer T1. A second terminal of the primary winding of the transformer TB1*d* is connected with a first terminal of the lamp Lp2. A first terminal of the secondary winding of the transformer TB1*c* is connected with a second terminal of the secondary winding of the transformer TB1*d*. A first terminal of the secondary winding of the transformer TB1*d* is connected with a second terminal of the secondary winding of the transformer TB1*c*. That is, with respect to the secondary windings of the transformers TB1*c* and TB1*d*, terminals of different polarities are connected to form a closed loop. In consequence, the same electrical current flows through the secondary windings of the transformers TB1*c* and TB1*d*. Therefore, electrical currents flowing through the primary windings of the transformers TB1*c* and TB1*d* to energize the lamps Lp1 and Lp2, respectively, are made identical. That is, the lamps Lp1 and Lp2 are made uniform in brightness. In this respect, the third embodiment is identical with the second embodiment.

On the other hand, the input terminal of the voltage-dividing-and-rectifying circuit 18 is connected with the first terminal of the secondary winding of the transformer T1. A voltage corresponding to the voltage VMT is detected by the voltage-dividing-and-rectifying circuit 18. The first terminal of the tertiary winding of the transformer TB1*c* is connected with the anode of the diode 20*a*, the second terminal being grounded. Similarly, a first terminal of the tertiary winding of the transformer TB1*d* is connected with the anode of the diode 20*b*, whereas a second terminal is grounded. The cathodes of the diodes 20*a* and 20*b* are connected with each other and with the input terminal of the voltage addition circuit 19. A voltage corresponding to a maximum voltage VBmax of the voltage VB1 on the primary winding side of the transformer TB1*c* and the voltage VB2 on the primary winding side of the transformer TB1*d* appears at the input terminal of the voltage addition circuit 19. Especially, where the primary winding of the transformer TB1*c* or TB1*d* is short-circuited or the lamp Lp1 or Lp2 is at fault such that the currents on the primary winding sides of the transformers TB1*c* and TB1*d* go out of balance, a voltage of a large value appears. Accordingly, in the voltage addition circuit 19, the sum (VMT+VBmax) of a voltage corresponding to the voltage VMT and a voltage corresponding to VBmax is output to the overvoltage-limiting circuit 13.

The third embodiment described below is identical in operation and configuration with the first and second embodiments. In the first and second embodiments, a voltage-dividing-and-rectifying circuit is mounted for each lamp. Since the voltage to be divided is very high, capacitors with high voltage resistance must be used. Furthermore, many restrictions such as part spacing are imposed on high-voltage circuits. Therefore, a circuit as in the first or second embodiment may not be adopted in some cases. In such a case, use of the transformers TB1*c* and TB1*d* having the tertiary windings and diodes 20*a* and 20*b* as in the present embodiment reduces the possibility of occurrence of the above-described problem. Nonetheless, the same voltages as used in the first and second embodiments are detected by the voltage addition circuit 19. Consequently, the same advantages are derived as in the first and second embodiments. That is, the lamps Lp1 and Lp2 are made uniform in brightness. Inexpensive transformers can be used by lowering the withstand voltages of the transformers.

D. Fourth Embodiment

An example of circuit of a lamp-lighting apparatus associated with a fourth embodiment of the present invention is shown in FIG. 7. The lamp-lighting apparatus associated with the fourth embodiment has an inverter including a switching circuit, an inverter transformer T2, shunt transformers TB11-TB1*n*, voltage-dividing-and-rectifying circuits 22-2*n*, lamps Lp11-Lp1*n*, a resistor R21, a comparator 26 for lamp voltage detection, a comparator 27 for lamp current detection, an AND circuit 28, and a control circuit 29. A resonant circuit 21 having a resonant frequency higher than the switching frequency of the switching circuit is formed on the secondary winding side of the inverter transformer T2 by the leakage component of the secondary winding side of the inverter transformer T2, parasitic capacitance between the resonant capacitor and lamp, and parasitic capacitance between the lamp and panel.

The inverter is connected with the primary winding of the inverter transformer T2. One end of the secondary winding of the inverter transformer T2 is connected with respective one ends of the primary and secondary windings of the shunt transformer TB11, with one end of the secondary winding of the shunt transformer TB12, and with one end of the secondary winding of the shunt transformer TB1*n*. The other end of the secondary winding of the inverter transformer T2 is grounded. The other end of the primary winding of the shunt transformer TB11 is connected with the lamp Lp11. The other end of the secondary winding is connected with one end of the primary winding of the shunt transformer TB12. The other end of the primary winding of the shunt transformer TB12 is connected with the lamp Lp12. The other end of the secondary winding is connected with one end of the primary winding of the shunt transformer TB1*n*. The other end of the primary winding of the shunt transformer TB1*n* is connected with the lamp Lp13. The other end of the secondary winding of the shunt transformer TB1*n* is connected with the lamp Lp1*n*. The other ends of the lamps Lp11-Lp1*n* are connected with one end of the resistor R21, the other end of the resistor R21 being grounded.

The junction between the shunt transformer TB11 and the lamp Lp11 is connected with the voltage-dividing-and-rectifying circuit 22. The junction between the shunt transformer TB12 and the lamp Lp12 is connected with the voltage-dividing-and-rectifying circuit 23. The junction between the primary winding of the shunt transformer TB1*n* and the lamp Lp13 is connected with the voltage-dividing-and-rectifying circuit 24. The junction between the secondary winding of the shunt transformer TB1*n* and the lamp Lp1*n* is connected with the voltage-dividing-and-rectifying circuit 2*n*. In the voltage-dividing-and-rectifying circuits 22-2*n*, capacitors C1 and C2 are connected in series. One end of the capacitor C2 is grounded. The cathode of a diode D2 is connected with the junction between the capacitors C1 and C2. The anode of the diode D2 is connected with the ground. Similarly, the anode of the diode D1 is connected with the junction between the capacitors C1 and C2. The cathode of the diode D1 forms the outputs of the voltage-dividing-and-rectifying circuits 22-2*n*. The outputs from the voltage-dividing-and-rectifying circuits 22-2*n* are sent to the comparator 26 for lamp voltage detection. The junctions of the lamps Lp11-Lp1*n* and the resistor R21 are connected with the comparator 27 for lamp current detection.

The output from the comparator 26 for lamp voltage detection and the output from the comparator 27 for lamp current detection are applied to the AND circuit 28, whose output is connected with the control circuit 29. The control circuit 29 controls switching performed by the switching circuit included in the inverter. In this embodiment, the frequency is increased to the resonant frequency of the resonant circuit during the start mode and returned to the normal switching frequency when the start mode ends. In some cases, the frequency may be set to a frequency other than the resonant frequency because some degree of gain can be obtained if the frequency is not set to the resonant frequency.

The operation of the circuit shown in FIG. 7 is described by referring to FIG. 8. First, when the lamp-lighting apparatus turns on as shown in (a) of FIG. 8, the output from the comparator 26 for lamp voltage detection and the output from the comparator 27 for lamp current detection are ANDed off as shown in (f) of FIG. 8. While the output from the AND circuit 28 is off, the control circuit 29 interprets the mode as the start mode and sets the switching frequency of the switching circuit of the inverter to the resonant frequency of the resonant circuit. To perform soft start, the output voltage from the inverter is gradually increased. As shown in (b) of FIG. 8, the voltages (lamp voltages) at the junctions of the shunt transformers TB11-TB1*n* and lamps Lp11-Lp1*n* increase gradually. The output voltages from the voltage-dividing-and-rectifying circuits 22-2*n* increase gradually. Since the lamp voltages are alternating currents, their waveforms spread in the up-and-down direction in (b) of FIG. 8. The highest one of the output voltages from the voltage-dividing-and-rectifying circuit 22-2*n* is applied to the lamp voltage detection comparator 26. The comparator 26 for lamp voltage detection is preset to a threshold value 61 for voltage detection. If the absolute value of any one of the output voltages from the voltage-dividing-and-rectifying circuits 22-2*n* exceeds the threshold value 61, the output from the comparator 26 for lamp voltage detection is turned on (low active) as shown in (d) of FIG. 8. If there is any unlit lamp, the output voltage from the corresponding one of the voltage-dividing-and-rectifying circuits 22-2*n* is increased compared with when all the lamps are lit up. The threshold value 61 for voltage detection is set such that this situation can be detected.

The comparator 27 for detection of the lamp currents takes out all the currents (lamp currents) flowing through the lamps Lp11-Lp1*n* by means of the resistor R21. The lamp currents are increased gradually by soft start. As shown in (c) of FIG. 8, if such a lamp current exceeds a threshold value 62 for current detection, the output from the comparator 27 goes high as shown in (e) of FIG. 8, the comparator 27 being preset to the threshold value 62.

If only the output from the comparator 26 for lamp voltage detection is observed during the startup stage as described above, the start of the start mode will be delayed. However, the lamp current is kept relatively low for a while from the start and so the output from the comparator 27 for lamp current detection goes low. The start mode can be initiated when the lamp-lighting apparatus is turned on, by combining the output from the comparator 26 lamp voltage detection and the output from the comparator 27 for lamp current detection. In the start mode, a higher voltage is produced on the secondary winding side of the inverter transformer T2 by the resonant circuit, thus lighting up the lamp quickly. Accordingly, it is anticipated that the lamp will be lit up more quickly if the start mode is initiated more quickly. The threshold value 62 for lamp current detection is set such that the lamp current exceeds the threshold value for lamp current detection after the output from the comparator 26 goes low.

When all the lamps light up, the lamp voltage decreases as shown in (b) of FIG. 8. When the voltage decreases below the threshold value 61 for voltage detection, the output from the comparator 26 for lamp voltage detection goes high as shown in (d) of FIG. 8. That is, as shown in (e) of FIG. 8, since the output from the comparator 27 for lamp current detection is at high, the output from the AND circuit 28 goes high as shown in (f) of FIG. 8. The mode is switched from the start mode to RUN mode (normal mode). Since the mode goes to the RUN mode after checking lighting of the lamps in this way, the start mode of low efficiency can be appropriately ended. In the control circuit 29, shifting to the RUN mode is detected in response to the output from the AND circuit 28. The switching frequency of the switching circuit is returned to the normal frequency.

Where the start mode is not instructed to end after a lapse of a given time, there is a possibility that any lamp has a problem. It is assumed here that the mode automatically shifts to the RUN mode.

The processing described so far makes it possible to appropriately switch the mode between the RUN mode and the start mode in which the voltage applied to each lamp is increased using resonance.

E. Fifth Embodiment

An example of circuit of a lamp-lighting apparatus associated with a fifth embodiment of the present invention is shown in FIG. 9. The lamp-lighting apparatus associated with the fifth embodiment is a modification of the lamp-lighting apparatus associated with the fourth embodiment. In the fifth embodiment, a balancer 30 including transformers TB11*a*-TB1*na* is provided instead of the shunt transformers TB11-TB1*n*. With respect to the transformers TB11*a*-TB1*na*, voltages which are in phase with the voltages on the primary windings are produced on the secondary windings. The balancer 30 is similar in configuration with the balancer 17 described in the second embodiment.

That is, a first terminal of the primary winding of the transformer TB11*a* is connected with the inverter transformer T2 via the resonant circuit 21. A second terminal of the primary winding of the transformer TB11*a* is connected with the lamp Lp11 and with the voltage-dividing-and-rectifying circuit 22. Similarly, a first terminal of the primary winding of the transformer TB12*a* is connected with the inverter transformer T2 via the resonant circuit 21. A second terminal of the primary winding of the transformer TB12*a* is connected with the lamp Lp12 and with the voltage-dividing-and-rectifying circuit 23. A first terminal of the primary winding of the transformer TB13*a* is connected with the inverter transformer T2 via the resonant circuit 21. A second terminal of the primary winding of the transformer TB13*a* is connected with the lamp Lp13 and with the voltage-dividing-and-rectifying circuit 24. Furthermore, a first terminal of the primary winding of the transformer TB1*na* is connected with the inverter transformer T2 via the resonant circuit 21. A second terminal of the primary winding of the transformer TB1*na* is connected with the lamp Lp1*n* and with the voltage-dividing-and-rectifying circuit 2*n*. A first terminal of the secondary winding of the transformer TB11*a* is connected with the first terminal of the secondary winding of the transformer TB1*na*. The second terminal of the secondary winding of the transformer TB11*a* is connected with the first terminal of the secondary winding of the transformer TB12*a*. Similarly, the second terminal of the secondary winding of the transformer TB12*a* is connected with the first terminal of the secondary winding of the transformer TB13*a*. The second terminal of the secondary winding of the transformer TB13*a* is connected with the first terminal of the secondary winding of the transformer TB14*a* (not shown). In addition, the second terminal of the secondary winding of the transformer TB1(*n*−1)a is connected with the first terminal of the secondary winding of the transformer TB1*na*.

That is, with respect to the secondary windings of the transformers TB11*a* and TB1*na*, terminals of different polarities are connected to form a closed loop. In this way, electrical currents flowing into the secondary windings of the transformers TB11*a* and TB1*na* are made identical. Therefore, electrical currents flowing through the primary windings of the transformers TB11*a* and TB1*na* to energize the lamps Lp11-Lp1*n* are made uniform. That is, the lamps Lp11-Lp1*n* are made uniform in brightness.

The lamp-lighting apparatus associated with the fifth embodiment are identical in other configurations and operations with the lamp-lighting apparatus of the fourth embodiment and their description is omitted.

F. Sixth Embodiment

An example of circuit of a lamp-lighting apparatus associated with a sixth embodiment of the present invention is shown in FIG. 10. The lamp-lighting apparatus associated with the sixth embodiment is a modification of the lamp-lighting apparatus associated with the fifth embodiment and has a balancer 30*a* including capacitors CB1-CBn instead of the shunt transformers TB11-TB1*n*. One end of the capacitor CB1 is connected with the transformer T2 via the resonant circuit 21, the other end of the capacitor CB1 being connected with the first terminal of the lamp Lp11. One end of the capacitor CB2 is connected with the transformer T2 via the resonant circuit 21. The other end of the capacitor CB2 is connected with the first terminal of the lamp Lp12. One end of the capacitor CB3 is connected with the transformer T2 via the resonant circuit 21. The other end of the capacitor CB3 is connected with the first terminal of the lamp Lp13. One end of the capacitor CBn is connected with the transformer T2 via the resonant circuit 21. The other end of the capacitor CBn is connected with a first terminal of the lamp Lp1*n*.

In this configuration, too, the mode can be appropriately switched between the RUN mode and the start mode in which the voltage applied to each lamp is increased using resonance, in the same way as in the fourth and fifth embodiments.

G. Seventh Embodiment

An example of circuit of a lamp-lighting apparatus associated with a seventh embodiment of the present invention is shown in FIG. 11. The lamp-lighting apparatus associated with the seventh embodiment is a modification of the lamp-lighting apparatus associated with the fifth embodiment and has a balancer 30*b* equipped with transformers TB11*b*-Tb1*nb* instead of the shunt transformers TB11-TB1*n*. Furthermore, diodes D3-D6 are provided instead of the voltage-dividing-and-rectifying circuits 22-2*n*. In the transformers TB11*b*-TB1*nb*, voltages which are in phase with the voltages on the primary windings are produced on the secondary and third windings.

That is, a first terminal of the primary winding of the transformer TB11*b* is connected with the inverter transformer T2 via the resonant circuit 21. A second terminal of the primary winding of the transformer TB11*b* is connected with the lamp Lp11. Similarly, a first terminal of the primary winding of the transformer TB12*b* is connected with the inverter transformer T2 via the resonant circuit 21. A second terminal of the primary winding of the transformer TB12*b* is connected with the lamp Lp12. A first terminal of the primary winding of the transformer TB13*b* is connected with the inverter transformer T2 via the resonant circuit 21. A second terminal of the primary winding of the transformer TB13*b* is connected with the lamp Lp13. A first terminal of the primary winding of the transformer TB1*nb* is connected with the inverter transformer T2 via the resonant circuit 21. A second terminal of the primary winding of the transformer TB1*nb* is connected with the lamp Lp1*n*. The first terminal of the secondary winding of the transformer TB11*b* is connected with the second terminal of the secondary winding of the transformer TB1*nb*. The second terminal of the secondary winding of the transformer TB11*b* is connected with the first terminal of the secondary winding of the transformer TB12*b*. Similarly, the second terminal of the secondary winding of the transformer TB12*b* is connected with the first terminal of the secondary winding of the transformer TB13*b*. The second terminal of the secondary winding of the transformer TB13*b* is connected with the first terminal of the secondary winding of the transformer TB14*b* (not shown). The second terminal of the secondary winding of the transformer TB1(*n*−1)b is connected with the first terminal of the secondary winding of the transformer Tb1*nb*.

That is, with respect to the secondary windings of the transformers TB11*b* and TB1*nb*, terminals of different polarities are connected to form a closed loop. In this way, the electrical currents flowing through the secondary windings of the transformers TB11*b* and TB1*nb* are made identical. Therefore, the currents flowing through the primary windings of the transformers TB11*b* and TB1*nb* to energize the lamps Lp11-Lp1*n* are made identical. That is, the lamps Lp11-Lp1*n* are made uniform in brightness.

The first terminal of a tertiary winding of the transformer TB11*b* is connected with the anode of the diode D3. The second terminal of the tertiary winding of the transformer TB11*b* is grounded. The first terminal of the tertiary winding of the transformer TB12*b* is connected with the anode of the diode D4, the second terminal of the tertiary winding of the transformer TB12*b* being grounded. The first terminal of the tertiary winding of the transformer TB13*b* is connected with the anode of the diode D5, while the second terminal of the tertiary winding of the transformer TB13*b* is grounded. A first terminal of the tertiary winding of the transformer TB1*nb* is connected with the anode of the diode D6, while the second terminal of the tertiary winding of the transformer TB1*nb* is grounded. The cathodes of the diodes D3-D6 are connected with each other and with the input terminal of the comparator 26 for lamp voltage detection.

Voltages corresponding to the voltages produced on the primary windings are produced on the tertiary windings of the transformers TB11*b*-TB1*nb*. Since the cathodes of the diodes D3-D6 connected with the tertiary windings of the transformers TB11*b*-TB1*nb* are connected, a maximum one of voltages produced on the tertiary windings of the transformers TB11*b*-TB1*nb*, i.e., a maximum one of the voltages corresponding to the voltages on the primary windings, is produced. Where this circuit is adopted, what is detected is not a lamp voltage unlike in the fourth through sixth embodiments. However, the detected voltage corresponds to the lamp voltage. The same operation is performed as in the fifth embodiment if the threshold value is set appropriately.

In the fifth and sixth embodiments, a voltage-dividing-and-rectifying circuit is provided for each lamp. A voltage to be divided is very high and so capacitors withstanding high voltages must be used. Furthermore, many limitations such as part spacing are imposed on high-voltage circuits. Therefore, in some cases, a circuit as shown in the fifth or sixth embodiment cannot be adopted. In such a case, the aforementioned problem can be prevented by using transformers TB11*b* and TB1*nb* having tertiary windings and diodes D3-D6 as in the present embodiment. A variation in the voltage on the primary winding produced according to a lamp voltage can be detected on the tertiary winding. Imbalance between the lamp voltages can be detected by the comparator 26 for lamp voltage detection via the diodes D3-D6.

H. Eighth Embodiment

An example of circuit of a lamp-lighting apparatus associated with an eighth embodiment of the present invention is shown in FIG. 12. The lamp-lighting apparatus associated with the eighth embodiment has a first inverter including a switching circuit, a second inverter including a switching circuit, a first inverter transformer T3, a second inverter transformer T4, shunt transformers TB21-TB2*n* having primary through tertiary windings, shunt transformers TB31-TB3*n* having primary through tertiary windings, diodes D11-D1*n*, diodes D21-D2*n*, lamps Lp31-Lp3*n*, a comparator 31, and a control circuit 32. With respect to the shunt transformers TB31-TB3n, voltages which are in phase with the voltages on the primary windings are produced on the secondary and tertiary windings.

The first inverter is connected with the primary winding of the first inverter transformer T3. A circuit including the first inverter and surrounded by the dot-and-dash line acts as a master circuit. One end of the secondary winding of the first inverter transformer T3 is connected with respective one ends of the primary and secondary windings of the shunt transformer TB21, with one end of the secondary winding of the shunt transformer TB22, and with one end of the secondary winding of the shunt transformer TB2n. The other end of the secondary winding of the first inverter transformer T3 is grounded. The other end of the primary winding of the shunt transformer T21 is connected with the lamp Lp31. The other end of the secondary winding is connected with one end of the primary winding of the shunt transformer T22. The other end of the primary winding of the shunt transformer T22 is connected with the lamp Lp32. The other end of the secondary winding is connected with one end of the primary winding of the shunt transformer T2n. The other end of the primary winding of the shunt transformer T2n is connected with the lamp Lp3n. The other end of the secondary winding of the shunt transformer T2n is connected with one end of the secondary winding of the shunt transformer T3n.

The second inverter is connected with the primary winding of the second inverter transformer T4. A circuit including the second inverter and surrounded by the dot-and-dash line acts as a slave circuit. One end of the secondary winding of the second inverter transformer T4 is connected with respective one ends of the primary and secondary windings of the shunt transformer TB31, with one end of the secondary winding of the shunt transformer TB32, and with the other end of the secondary winding of the shunt transformer TB3n. The other end of the secondary winding of the second inverter transformer T4 is grounded. The other end of the primary winding of the shunt transformer TB31 is connected with the lamp Lp31, while the other end of the secondary winding is connected with one end of the primary winding of the shunt transformer TB32. The other end of the primary winding of the shunt transformer TB32 is connected with the lamp Lp32. The other end of the secondary winding is connected with the primary winding of the shunt transformer TB3n. The other end of the primary winding of the shunt transformer TB3n is connected with the lamp Lp3n. The other end of the secondary winding of the shunt transformer TB3n is connected with one end of the secondary winding of the shunt transformer TB2n. In this way, the lamps Lp31-Lp3n are differentially energized. That is, the first and second inverters are operated in 180 degree out-of-phase and put into oscillation. With respect to the secondary windings of the shunt transformers TB21-TB2n, terminals of different polarities are connected. Similarly, with respect to the secondary windings of the shunt transformers TB31-TB3n, terminals of different polarities are connected. Furthermore, with respect to the secondary windings of the shunt transformer TB2n and TB3n, terminals of the same polarity are connected.

One end of the tertiary winding of the shunt transformer TB21 is connected with the anode of the diode D11, the other end being grounded. The cathode of the diode D11 is connected with the input of the comparator 31. One end of the tertiary winding of the shunt transformer TB22 is connected with the anode of the diode D12, the other end being grounded. The cathode of the diode D12 is connected with the input of the comparator 31. One end of the tertiary winding of the shunt transformer TB2n is connected with the anode of the diode D1n, the other end being grounded. The cathode of the diode D1n is connected with the input of the comparator 31. One end of the tertiary winding of the shunt transformer TB31 is connected with the anode of the diode D21, the other end being grounded. The cathode of the diode D21 is connected with the input of the comparator 31. One end of the tertiary winding of the shunt transformer TB32 is connected with the anode of the diode D22, the other end being grounded. The cathode of the diode D22 is connected with the input of the comparator 31. One end of the tertiary winding of the shunt transformer TB3n is connected with the anode of the diode D2n, the other end being ground. The cathode of the diode D2n is connected with the input of the comparator 31.

The output from the comparator 31 is input to the control circuit 32. The output from the control circuit 32 controls the first and second inverters.

In this way, the shunt transformers TB21-TB2n and shunt transformers TB31-TB3n are all connected throughout the circuitry, neither only in the master circuit nor only in the slave circuit. Hence, the circuitry operates such that the electrical currents flowing through the lamps Lp31-Lp3n are made uniform. Accordingly, both ends of each of the lamps Lp31-Lp3n are made uniform in brightness. In the lamp-lighting circuit of FIG. 12, the tertiary windings of the shunt transformers TB21-TB2n and shunt transformers TB31-TB3n detect voltages produced on the shunt transformers, respectively. The voltage signals are diode ORed and input to the comparator 31.

If the terminals of the secondary winding of the first inverter transformer T3 of the master circuit are short-circuited, e.g., when a person touches them, the output voltage from the first inverter transformer T3 drops. Since the second inverter transformer T4 in the slave circuit is energized parallel to the first inverter transformer T3 at the same duty cycle, the output voltage from the first inverter transformer T3 becomes lower than the output voltage from the second inverter transformer T4. When a voltage difference is produced between the outputs from the first and second inverter transformers in this way, a difference is produced between the lamp current through the master circuit and the lamp current through the slave circuit. At this time, the shunt transformer tries to produce a voltage to bring the lamp current through the master circuit into agreement with the lamp current through the slave circuit, for achieving a balance between the currents.

Then, a higher voltage is produced on the tertiary winding of the shunt transformer than that during normal operation. The voltage can be detected by the comparator 31. If a variation in the voltage is detected, the comparator 31 outputs a detection signal to the control circuit 32. The control circuit 32 responds to the detection signal, stopping switching done by the switching circuits included in the first and second inverters. The output from the comparator 31 is kept latched until the power supply is turned on again. In a case, for example, where a problem occurs with any one of the lamps Lp31-Lp3n as well as in a case where a problem occurs with the inverter transformer T3 or T4, the current flowing through the shunt transformer varies. Therefore, this can be detected by the comparator 31.

In the example of FIG. 12, electrical currents are detected by providing a tertiary winding to each shunt transformer. The currents may be detected by other method. Since the shunt transformer in the master circuit and the shunt transformer in the slave circuit are interconnected, the device operates to make uniform the currents flowing through all the shunt transformers. Accordingly, when an unbalance occurs in any one shunt transformer, the effect acts on the other shunt transformers. Consequently, occurrence of a problem can be detected by providing a circuit for detecting variations in the electrical current flowing through at least any one shunt transformer.

In this way, according to the eighth embodiment, a fault with a lamp-lighting apparatus is detected if any, and the operation of the lamp-lighting circuit is then stopped. Therefore, the safety can be improved. Furthermore, the safety can also be enhanced by limiting the output current without stopping the operation. In some configurations, only one inverter transformer may be provided.

I. Ninth Embodiment

An example of circuit of a lamp-lighting apparatus associated with a ninth embodiment of the present invention is shown in FIG. 13. The lamp-lighting apparatus associated with the ninth embodiment is a modification of the lamp-lighting apparatus associated with the eighth embodiment and uses transformers TB21*a*-TB2*na* instead of the shunt transformers TB21-TB22. Furthermore, the lamp-lighting apparatus uses transformers TB31*a*-TB3*na* instead of the shunt transformers TB31-TB3*n*. With respect to the transformers TB21*a*-TB2*na* and transformers TB31*a*-TB3*na*, voltages having the same polarity as the voltages on the primary windings are produced on the secondary and tertiary windings.

A first terminal of the primary winding of the transformer TB21*a* is connected with a first terminal of the transformer T3. The second terminal of the primary winding of the transformer TB21*a* is connected with a first terminal of the lamp Lp31. A first terminal of the primary winding of the transformer TB22*a* is connected with a first terminal of the transformer T3. A second terminal of the primary winding of the transformer TB22*a* is connected with a first terminal of the lamp Lp32. A first terminal of the primary winding of the transformer TB2*na* is connected with a first terminal of the transformer T3. A second terminal of the primary winding of the transformer TB2*na* is connected with a first terminal of the lamp Lp3*n*. A first terminal of the primary winding of the transformer TB31*a* is connected with a first terminal of the transformer T4. A second terminal of the primary winding of the transformer TB31*a* is connected with a second terminal of the lamp Lp31. A first terminal of the primary winding of the transformer TB32*a* is connected with a first terminal of the transformer T4. A second terminal of the primary winding of the transformer TB32*a* is connected with a second terminal of the lamp Lp32. A first terminal of the primary winding of the transformer TB3*na* is connected with a first terminal of the transformer T4. A second terminal of the primary winding of the transformer TB3*na* is connected with a second terminal of the lamp Lp3*n*.

A first terminal of the secondary winding of the transformer TB21*a* is connected with a first terminal of the transformer TB31*a*. These terminals have the same polarity. On the other hand, a second terminal of the secondary winding of the transformer TB21*a* is connected with a first terminal of the secondary winding of the transformer TB22*a*. A second terminal of the secondary winding of the transformer TB22*a* is connected with a first terminal of the secondary winding of the transformer TB23*a* (not shown). A second terminal of the secondary winding of the transformer TB2(*n*−1)a is connected with a first terminal of the secondary winding of the transformer TB2*na*. In this way, with respect to the secondary windings of the upper stage of transformers TB21*a*-TB2*na*, terminals of different polarities are connected.

Furthermore, a second terminal of the secondary winding of the transformer TB2*na* is connected with a second terminal of the secondary winding of the transformer TB3*na*. These terminals have the same polarity. On the other hand, a first terminal of the secondary winding of the transformer TB3*na* is connected with the second terminal of the secondary winding of the transformer TB3(*n*−1)a (not shown). A first terminal of the secondary winding of the transformer TB33*a* is connected with a second terminal of the secondary winding of the transformer TB32*a*. A first terminal of the secondary winding of the transformer TB32*a* is connected with a second terminal of the secondary winding of the transformer TB31*a*. In this way, with respect to the secondary windings of the lower stage of transformers TB31*a*-TB3*na*, terminals of different polarities are connected.

As already described in the eighth embodiment, the lamps Lp31-Lp3*n* are differentially energized. Therefore, the upper stage of transformers TB21*a*-TB2*na* is different in polarity from the lower stage of transformers TB31*a*-TB3*na* during operation. Accordingly, with respect to the secondary windings of the transformers TB21*a* and TB31*a*, terminals of the same polarity are connected. Since the lamp Lp31 is differentially energized, terminals of different polarities are connected together in practice. Similarly, with respect to the secondary windings of the transformers T2*na* and TB3*na*, terminals of the same polarity are connected. Since the lamp Lp3*n* is differentially energized, terminals of different polarities are connected together in practice. That is, the secondary windings of the transformers TB21*a*-TB2*na* and the secondary windings of the transformers TB31*a*-TB3*na* form a closed loop. Terminals producing different polarities are connected.

In the ninth embodiment, the lamps Lp31-Lp3*n* are differentially energized in this way to make uniform the electrical currents flowing through the lamps. In consequence, the lamps Lp31-Lp3*n* are made uniform in brightness.

The ninth embodiment is similar in other configurations and operations with the eighth embodiment.

The present application claims priority to Japanese Patent Application No. 2004-322302, filed Nov. 5, 2004, and No. 2005-218201, filed Jul. 28, 2005, the disclosure of which is incorporated herein by reference in their entirety.

While embodiments of the present invention have been described so far, the invention is not limited thereto. For example, the foregoing embodiments may be combined arbitrarily. Furthermore, parts of the embodiments may be replaced by other circuits having similar functions without departing from the gist of the invention described above.

What is claimed is:

1. A lamp-lighting apparatus comprising:

an inverter transformer having a primary winding and a secondary winding;

a balancer coupled to the secondary winding of the inverter transformer and adapted to make more equal electrical currents flowing through a plurality of lamps, respectively, wherein said balancer has plural transformers, each of the transformers having a primary winding, a secondary winding, and a tertiary winding; and a control circuit adapted to detect whether all the lamps have been lit up, wherein the primary winding of each of the plural transformers is connected in series with a corresponding one of the lamps and with the secondary winding of the inverter transformer, wherein the secondary winding of each of the plural transformers is connected to form a closed loop with the secondary windings of the other plural transformers, and wherein the tertiary winding of each of the plural transformers is adapted to detect a voltage generated at the balancer.

2. The lamp-lighting apparatus as set forth in claim 1, wherein a separate diode connects each of the tertiary windings to a voltage comparator.

3. The lamp-lighting apparatus as set forth in claim 1, wherein a comparator determines whether all of the lamps are lit by comparing the highest voltage out of all of the lamps with a predetermined voltage value.

* * * * *